US012798731B2

(12) United States Patent
Armstrong et al.

(10) Patent No.: US 12,798,731 B2
(45) Date of Patent: Nov. 17, 2026

(54) SYSTEMS AND METHODS FOR WATERCRAFT STABILIZATION

(71) Applicant: Navico, Inc., Tulsa, OK (US)

(72) Inventors: Leigh Armstrong, Auckland (NZ); Mathew John Hooper, Auckland (NZ)

(73) Assignee: Navico, Inc., Tulsa, OK (US)

( * ) Notice: Subject to any disclaimer, the term of this patent is extended or adjusted under 35 U.S.C. 154(b) by 667 days.

(21) Appl. No.: 18/194,073

(22) Filed: Mar. 31, 2023

(65) Prior Publication Data

US 2024/0326959 A1 Oct. 3, 2024

(51) Int. Cl.

| | |
|---|---|
| ***B63B 39/03*** | (2006.01) |
| ***B63B 39/04*** | (2006.01) |
| ***B63B 39/06*** | (2006.01) |
| ***B63H 25/04*** | (2006.01) |
| *B63H 25/02* | (2006.01) |

(52) U.S. Cl.

CPC ..... *B63B 39/061* (2013.01); *B63B 39/03* (2013.01); *B63B 39/04* (2013.01); *B63H 2025/022* (2013.01); *B63H 25/04* (2013.01)

(58) Field of Classification Search

CPC ..... B63B 39/00; B63B 39/03; B63B 39/04; B63B 39/06; B63B 39/061; B63H 25/00; B63H 25/04

USPC ..... 114/122

See application file for complete search history.

(56) References Cited

U.S. PATENT DOCUMENTS

| | | | | |
|---|---|---|---|---|
| 5,113,780 | A | 5/1992 | Bennett et al. | |
| 5,385,110 | A | 1/1995 | Bennett et al. | |
| 6,138,601 | A | 10/2000 | Anderson et al. | |
| 6,354,237 | B1 | 3/2002 | Gaynor et al. | |
| 6,583,728 | B1 | 6/2003 | Staerzl | |
| 7,416,456 | B1 | 8/2008 | Gonring et al. | |
| 7,905,193 | B2 | 3/2011 | Beamer | |
| 8,216,007 | B2 * | 7/2012 | Moore | B63B 39/03 440/61 T |
| 8,261,682 | B1 | 9/2012 | DeVito | |
| 8,534,214 | B1 | 9/2013 | Gasper | |
| 8,539,897 | B1 | 9/2013 | Gasper et al. | |
| 8,578,873 | B2 | 11/2013 | Gasper et al. | |
| 8,798,825 | B1 | 8/2014 | Hartman | |
| 8,833,286 | B1 | 9/2014 | Sheedy et al. | |
| 9,067,644 | B2 | 6/2015 | Sheedy et al. | |

(Continued)

FOREIGN PATENT DOCUMENTS

| | | | |
|---|---|---|---|
| AU | 2014218466 | B2 | 11/2015 |
| AU | 2012308224 | B2 | 11/2016 |

(Continued)

*Primary Examiner* — Lars A Olson

(74) *Attorney, Agent, or Firm* — Nelson Mullins Riley & Scarborough LLP

(57) ABSTRACT

Example systems and methods are provided herein for stabilizing a watercraft during a turn of the watercraft. Such systems include a navigation assembly and a stabilization mechanism configured to apply forces to maintain the watercraft within a relative orientation with a body of water. The systems also include a memory and a processor, and the processor is configured to receive data from the navigation assembly to determine when a turn is being made or will be made, determine and apply an adjustment to the stabilization mechanism, and cause the adjustment to be applied to the stabilization mechanism.

18 Claims, 13 Drawing Sheets

(56) References Cited

U.S. PATENT DOCUMENTS

| | | | |
|---|---|---|---|
| 9,068,855 | B1 | 6/2015 | Guglielmo |
| 9,156,372 | B1 | 10/2015 | Guglielmo et al. |
| 9,174,703 | B2 | 11/2015 | Sheedy et al. |
| 9,199,695 | B2 | 12/2015 | Gasper et al. |
| 9,254,896 | B2 | 2/2016 | Bertalan et al. |
| 9,260,161 | B2 | 2/2016 | Gasper et al. |
| 9,278,740 | B1 | 3/2016 | Andrasko et al. |
| 9,315,235 | B1 | 4/2016 | Wood |
| 9,315,236 | B2 | 4/2016 | Gasper |
| 9,334,022 | B2 | 5/2016 | Gasper et al. |
| 9,446,823 | B2 | 9/2016 | Sheedy et al. |
| 9,499,242 | B2 | 11/2016 | Hartman |
| 9,505,464 | B1 | 11/2016 | Wood |
| 9,540,074 | B1 | 1/2017 | Pigeon |
| 9,580,147 | B2 | 2/2017 | Gasper et al. |
| 9,598,160 | B2 | 3/2017 | Andrasko et al. |
| 9,643,697 | B2 | 5/2017 | Sheedy et al. |
| 9,689,395 | B2 | 6/2017 | Hartman |
| 9,694,873 | B2 | 7/2017 | Gasper et al. |
| 9,745,036 | B2 | 8/2017 | Andrasko et al. |
| 9,751,605 | B1 | 9/2017 | Anschuetz et al. |
| 9,771,137 | B1 | 9/2017 | Gable et al. |
| 9,802,684 | B2 | 10/2017 | Sheedy et al. |
| 9,828,075 | B1 | 11/2017 | Hartman |
| 9,873,491 | B2 | 1/2018 | Hartman |
| 9,891,620 | B2 | 2/2018 | Green et al. |
| 9,914,503 | B2 | 3/2018 | Huyge et al. |
| 9,914,504 | B2 | 3/2018 | Gasper et al. |
| 9,919,781 | B1 | 3/2018 | Andrasko et al. |
| 9,926,043 | B1 | 3/2018 | Miller et al. |
| 9,937,984 | B2 | 4/2018 | Herrington et al. |
| 9,950,771 | B1 | 4/2018 | Hartman et al. |
| 9,988,126 | B2 | 6/2018 | Wood |
| 10,000,267 | B1 | 6/2018 | Anschuetz |
| 10,093,398 | B1 | 10/2018 | Hartman |
| 10,118,681 | B1 | 11/2018 | Andrasko et al. |
| 10,137,971 | B2 | 11/2018 | Andrasko et al. |
| 10,214,271 | B1 | 2/2019 | Gonring et al. |
| 10,241,746 | B2 | 3/2019 | Sheedy et al. |
| 10,259,534 | B2 | 4/2019 | Sheedy et al. |
| 10,260,904 | B2 | 4/2019 | Rajamani et al. |
| 10,266,241 | B2 | 4/2019 | Sheedy et al. |
| 10,308,321 | B1 | 6/2019 | Miller et al. |
| 10,322,777 | B2 | 6/2019 | Gasper et al. |
| 10,351,221 | B1 | 7/2019 | Anschuetz et al. |
| 10,358,189 | B2 | 7/2019 | Sheedy et al. |
| 10,377,453 | B2 | 8/2019 | Sheedy et al. |
| 10,386,834 | B2 | 8/2019 | Green et al. |
| 10,414,470 | B1 | 9/2019 | Hartman |
| 10,436,604 | B2 | 10/2019 | Rajamani et al. |
| 10,501,148 | B2 | 12/2019 | Huyge et al. |
| 10,501,156 | B1 | 12/2019 | Sheedy et al. |
| 10,518,856 | B2 | 12/2019 | Andrasko et al. |
| 10,577,054 | B1 | 3/2020 | Hartman et al. |
| 10,577,068 | B1 | 3/2020 | Gonring et al. |
| 10,640,182 | B1 | 5/2020 | Hartman |
| 10,683,061 | B2 | 6/2020 | Gasper et al. |
| 10,717,502 | B1 | 7/2020 | Hartman |
| 10,745,084 | B2 | 8/2020 | Forrest et al. |
| 10,759,507 | B2 | 9/2020 | Hartman |
| 10,797,907 | B1 | 10/2020 | Arbuckle et al. |
| 10,822,055 | B2 | 11/2020 | Sheedy et al. |
| 10,829,190 | B1 | 11/2020 | Pugh et al. |
| 10,858,068 | B1 | 12/2020 | Miller et al. |
| 10,899,416 | B1 | 1/2021 | Sheedy et al. |
| 10,922,045 | B2 | 2/2021 | Sheedy et al. |
| 10,926,848 | B1 | 2/2021 | Hartman |
| 11,014,638 | B1 | 5/2021 | Davis et al. |
| 11,040,757 | B2 | 6/2021 | Huyge et al. |
| 11,046,393 | B2 | 6/2021 | Sheedy et al. |
| 11,048,469 | B2 | 6/2021 | Lynema et al. |
| 11,067,979 | B2 | 7/2021 | Green et al. |
| 11,130,551 | B1 | 9/2021 | Hartman |
| 11,214,335 | B2 | 1/2022 | Sheedy et al. |
| 11,254,391 | B2 | 2/2022 | Larson et al. |
| 11,260,946 | B1 | 3/2022 | Przybyl et al. |
| 11,262,767 | B2 | 3/2022 | Karnick et al. |
| 11,301,205 | B2 | 4/2022 | Sheedy et al. |
| 11,312,460 | B2 | 4/2022 | Taylor et al. |
| 11,352,117 | B1 | 6/2022 | Blew |
| 11,358,680 | B1 | 6/2022 | Hartman |
| 11,370,508 | B1 | 6/2022 | Dugger et al. |
| 11,372,411 | B1 * | 6/2022 | Derginer ..... B63B 39/061 |
| 11,407,477 | B2 | 8/2022 | Dinninger et al. |
| 11,459,069 | B1 | 10/2022 | Miller et al. |
| 11,518,482 | B1 | 12/2022 | Dugger et al. |
| 11,535,347 | B2 | 12/2022 | Hartman |
| 11,572,136 | B2 | 2/2023 | Gasper et al. |
| 11,630,638 | B2 | 4/2023 | Sheedy et al. |
| 11,649,010 | B1 | 5/2023 | Hartman |
| 11,679,847 | B1 | 6/2023 | Hartman |
| 11,679,853 | B2 | 6/2023 | Wong et al. |
| 11,708,136 | B2 | 7/2023 | Sheedy et al. |
| 11,718,372 | B2 | 8/2023 | Huyge et al. |
| 11,753,116 | B1 | 9/2023 | Hartman et al. |
| 11,755,279 | B2 | 9/2023 | Lynema et al. |
| 11,772,756 | B1 | 10/2023 | Hartman |
| 11,834,132 | B2 | 12/2023 | Dinninger et al. |
| 12,172,736 | B1 * | 12/2024 | Timothy ..... B63B 49/00 |
| 2007/0078575 | A1 | 4/2007 | Wilson et al. |
| 2013/0340667 | A1 | 12/2013 | Morvillo |
| 2018/0128644 | A1 | 5/2018 | Lurcott et al. |
| 2019/0023368 | A1 | 1/2019 | Andrasko et al. |
| 2021/0024183 | A1 | 1/2021 | Dinninger et al. |
| 2021/0070413 | A1 | 3/2021 | Gulliksson et al. |
| 2021/0300506 | A1 | 9/2021 | Sheedy et al. |
| 2021/0303261 | A1 | 9/2021 | Lynema et al. |
| 2022/0075363 | A1 | 3/2022 | Green et al. |
| 2022/0081078 | A1 | 3/2022 | Sheedy et al. |
| 2022/0089258 | A1 | 3/2022 | Uggeri et al. |
| 2022/0097815 | A1 | 3/2022 | Taylor et al. |
| 2022/0177103 | A1 | 6/2022 | Marohl et al. |
| 2022/0348289 | A1 | 11/2022 | Ekern et al. |
| 2022/0348290 | A1 | 11/2022 | Dinninger et al. |
| 2022/0371701 | A1 | 11/2022 | Okamoto et al. |
| 2023/0090224 | A1 | 3/2023 | Dugger et al. |
| 2023/0278668 | A1 | 9/2023 | Gasper et al. |
| 2023/0303235 | A1 | 9/2023 | Wong et al. |
| 2023/0322338 | A1 | 10/2023 | Sheedy et al. |
| 2023/0348021 | A1 | 11/2023 | Huyge et al. |

FOREIGN PATENT DOCUMENTS

| | | | |
|---|---|---|---|
| AU | 2013205024 | B2 | 11/2016 |
| AU | 2012327219 | B9 | 2/2017 |
| AU | 2018325525 | B2 | 7/2022 |
| AU | 2018261570 | B2 | 10/2022 |
| AU | 2018261571 | B2 | 1/2023 |
| AU | 2021347242 | A1 | 3/2023 |
| CA | 210009 | A | 3/1921 |
| CA | 2863966 | C | 1/2017 |
| CA | 2937537 | A1 | 2/2017 |
| CA | 3059784 | A1 | 11/2018 |
| CA | 3056961 | C | 3/2022 |
| CA | 3190335 | A1 | 3/2022 |
| CA | 3071962 | C | 1/2023 |
| CA | 2937537 | C | 10/2023 |
| EP | 2536622 | A1 | 12/2012 |
| EP | 3313728 | B1 | 8/2019 |
| EP | 3313724 | B1 | 10/2019 |
| EP | 3619103 | A1 | 3/2020 |
| EP | 3619106 | A1 | 3/2020 |
| EP | 3676169 | A1 | 7/2020 |
| EP | 2976602 | B1 | 10/2020 |
| EP | 3604115 | B1 | 5/2021 |
| EP | 3860909 | A1 | 8/2021 |
| EP | 3790795 | B1 | 9/2022 |
| EP | 4217267 | A1 | 8/2023 |
| WO | WO 2011/099931 | A1 | 8/2011 |
| WO | 2013/040576 | A1 | 3/2013 |
| WO | 2013/071148 | A1 | 5/2013 |
| WO | 2014/153422 | A1 | 9/2014 |
| WO | 2016/209401 | A1 | 12/2016 |
| WO | 2016/209767 | A1 | 12/2016 |

(56) References Cited

FOREIGN PATENT DOCUMENTS

| | | | |
|---|---|---|---|
| WO | 2018/204170 | A1 | 11/2018 |
| WO | 2018/204171 | A1 | 11/2018 |
| WO | 2019/046682 | A1 | 3/2019 |
| WO | 2019/214811 | A1 | 11/2019 |
| WO | 2020/069617 | A1 | 4/2020 |
| WO | 2021/021718 | A1 | 2/2021 |
| WO | 2022/066855 | A1 | 3/2022 |
| WO | 2023/092228 | A1 | 6/2023 |

* cited by examiner

SYSTEMS AND METHODS FOR WATERCRAFT STABILIZATION

FIELD OF THE INVENTION

Example embodiments of the present invention generally relate to watercrafts and, more particularly to, systems and methods for stabilizing a watercraft during navigation, such as during a turn.

BACKGROUND

Watercraft often contain stabilization mechanisms that are configured to prevent or limit the watercraft from tilting or rocking. Such stabilization mechanisms are useful in stabilizing the watercraft when weight shifts within the watercraft occur, to maintain planing at lower speeds, and/or to correct rolling or bouncing. These systems are typically controllable by a user, such as by using buttons that are located near a steering wheel on the watercraft.

BRIEF SUMMARY

When the watercraft makes a turn, such stabilization mechanisms typically try to fight against the turn in an effort to maintain the watercraft within a certain orientation. However, a watercraft naturally turns or rolls during a turn, so the rolling or turning of the watercraft during a turn is inevitable. The engagement of the stabilization mechanisms during a turn puts strain on the watercraft and can lead to breakage. Although a user may be able to manually turn the stabilization mechanisms off for the duration of a turn, the user has many other tasks to complete during the turn (such as steering, watching for other watercrafts, avoiding obstacles in the water, etc.), so it might not be easy for a user to do so.

Some example embodiments of the present invention include systems and methods for managing stabilization mechanisms on a watercraft, such as during a turn. For example, disclosed herein are systems and methods for neutralizing and/or adjusting stabilization mechanisms on a watercraft automatically for a duration of a turn. In some embodiments, the systems and methods disclosed herein are configured to receive information from a navigation assembly such as an autopilot navigation assembly or an assembly with sensors to detect movement of a steering wheel. The systems and methods are then configured to determine, based on the information received, an adjustment for a stabilization mechanism on the watercraft for a duration of a turn. In some embodiments, the adjustment consists of simply turning off or disengaging the stabilization mechanism for the duration of the turn. In other embodiments, the adjustment is configured to cause the stabilization mechanism to assist the watercraft in making a turn. For example, the adjustment may be configured to cause the stabilization mechanism to encourage the watercraft in its natural roll during the turn. The adjustment is applied until the turn is complete, and in some embodiments, the systems and methods then include re-adjusting the stabilization mechanism such that it returns to its previous parameters. Further, in some embodiments, the watercraft may have multiple stabilization mechanisms, and the systems and methods described herein are configured to determine and apply adjustments to multiple or all of the stabilization mechanisms on the watercraft for the duration of the turn.

The systems and methods disclosed herein are designed to optimize the use of stabilization mechanisms on a watercraft without requiring more actions or thought by the user of the watercraft. For example, although the stabilization mechanisms on the watercraft may be adjustable by the user during a turn of the watercraft, the user may choose not to adjust the stabilization mechanisms on the watercraft during the turn because the user is preoccupied with other necessary tasks during the turn. Additionally or alternatively, even if the user does decide to manually adjust the stabilization mechanisms on the watercraft for a duration of a turn, he or she may forget to re-adjust the stabilization mechanisms after the turn is complete. Further, even in situations where a user may decide to manually adjust the stabilization mechanisms on the watercraft to prevent strain on the watercraft and/or to assist in the turn, the systems and methods disclosed herein free the user so that the user can relax or complete other tasks. In this regard, in some embodiments, example systems and methods described herein may be utilized automatically, such as while autopilot is operating the watercraft.

In an example embodiment, a system is provided for stabilizing a watercraft. The system includes a navigation assembly, at least one stabilization mechanism for stabilizing the watercraft, the at least one stabilization mechanism configured to apply a stabilization force onto the watercraft in an effort to cause the watercraft to maintain a relative orientation with a body of water, a processor, and a memory including computer executable instructions. The computer executable instructions are configured to, when executed by the processor, cause the processor to receive data from at least one of the navigation assembly, the memory, or a sensor. The data indicates that the watercraft is making a turn or will make the turn. The computer executable instructions are also configured to, when executed by the processor, cause the processor to determine, based on the data, an adjustment for the at least one stabilization mechanism to be applied during the turn by the watercraft. The adjustment either neutralizes the stabilization force being applied by the at least one stabilization mechanism or causes an adjusted stabilization force to be applied by the at least one stabilization mechanism to aid in making the turn. The computer executable instructions are also configured to, when executed by the processor, cause the processor to cause the determined adjustment to be applied to the at least one stabilization mechanism.

In some embodiments, the navigation assembly may be an autopilot navigation assembly.

In some embodiments, the processor may be configured to receive the data from the autopilot navigation assembly indicating that the watercraft will make the turn, and the adjustment may cause the adjusted stabilization force to be applied by the at least one stabilization mechanism to aid in making the turn. The adjustment may be applied before the turn begins.

In some embodiments, the navigation assembly may be following a predetermined navigation route, and the processor may be configured to receive the data from the navigation assembly indicating that the watercraft will make the turn. The adjustment may be applied before the turn begins.

In some embodiments, the navigation assembly may include a steering wheel, and the navigation data may indicate that the watercraft is making a turn when the steering wheel has been turned a predetermined number of degrees. The adjustment may be applied when the turn begins.

In some embodiments, the processor may be further configured to cause the determined adjustment to be applied to the at least one stabilization mechanism before the turn begins.

In some embodiments, the at least one stabilization mechanism may be at least two stabilization mechanisms, and the processor may be configured to determine, based on the data, an adjustment for each of the at least two stabilization mechanisms to be applied during the turn by the watercraft. The adjustments may either neutralize the stabilization force being applied by the at least two stabilization mechanisms or may cause adjusted stabilization forces to be applied by the at least two stabilization mechanisms to aid in making the turn. The processor may be further configured to determine the adjustments for each of the at least two stabilization mechanisms proportionately.

In some embodiments, the processor may predict a numerical value of instability to be caused by the turn.

In some embodiments, the numerical value of instability may be used to determine the adjustment.

In some embodiments, the processor may be further configured to cause the determined adjustment to be applied to the at least one stabilization mechanism when the turn begins, and the processor may adjust the at least one stabilization mechanism within select parameters based on detected circumstances of the turn.

In some embodiments, the detected circumstances may be at least one of weather conditions or waves.

In some embodiments, the at least one stabilization mechanism may include at least one of a gyro stabilizer, a trim tab system, a steering stabilization mechanism, interceptors, fin stabilizers, or one or more ballast tanks.

In some embodiments, the at least one stabilization mechanism may be a trim tab system, and the processor may be further configured to communicate a tilt value from the navigation assembly to the trim tab system according to a detected or predicted instability value associated with the turn. The tilt value may be used to determine the adjustment.

In some embodiments, the tilt value communicated to the trim tab system may be calculated such that the watercraft remains stable during the turn.

In some embodiments, the processor may be further configured to cause the trim tab system to return to an initial condition after the turn has been completed.

In some embodiments, causing the determined adjustment to be applied to the at least one stabilization mechanism according to the received data may include temporarily disengaging the at least one stabilization mechanism for a duration of the turn.

In some embodiments, the processor may be further configured to re-engage the at least one stabilization mechanism after the duration of the turn.

In some embodiments, the determined adjustment for the at least one stabilization mechanism is designed to cause a floor of the watercraft to maintain a relative orientation with the body of water that is less than 35 degrees.

In another example embodiment, a method is provided for stabilizing a watercraft. The method includes receiving data from at least one of a navigation assembly, a memory, or a sensor. The data indicates that the watercraft is making a turn or will make the turn. The method also includes determining, based on the data, an adjustment for at least one stabilization mechanism to be applied during the turn by the watercraft. The at least one stabilization mechanism is configured to stabilize the watercraft by applying a stabilization force onto the watercraft in an effort to cause the watercraft to maintain a relative orientation with a body of water, and the adjustment either neutralizes the stabilization force being applied by the at least one stabilization mechanism or causes an adjusted stabilization force to be applied by the at least one stabilization mechanism to aid in making the turn. The method also includes causing the determined adjustment to be applied to the at least one stabilization mechanism.

In another example embodiment, a marine electronic device is provided. The marine electronic device includes a processor and a memory including computer executable instructions. The computer executable instructions are configured to, when executed by the processor, cause the processor to receive data from at least one of a navigation assembly, the memory, or a sensor. The data indicates that a watercraft is making a turn or will make the turn. The computer executable instructions are also configured to, when executed by the processor, cause the processor to determine, based on the navigation data, an adjustment for at least one stabilization mechanism to be applied during the turn by the watercraft. The at least one stabilization mechanism is configured to stabilize the watercraft by applying a stabilization force onto the watercraft in an effort to cause the watercraft to maintain a relative orientation with a body of water, and the adjustment either neutralizes the stabilization force being applied by the at least one stabilization mechanism or causes an adjusted stabilization force to be applied by the at least one stabilization mechanism to aid in making the turn. The computer executable instructions are also configured to, when executed by the processor, cause the processor to cause the determined adjustment to be applied to the at least one stabilization mechanism.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
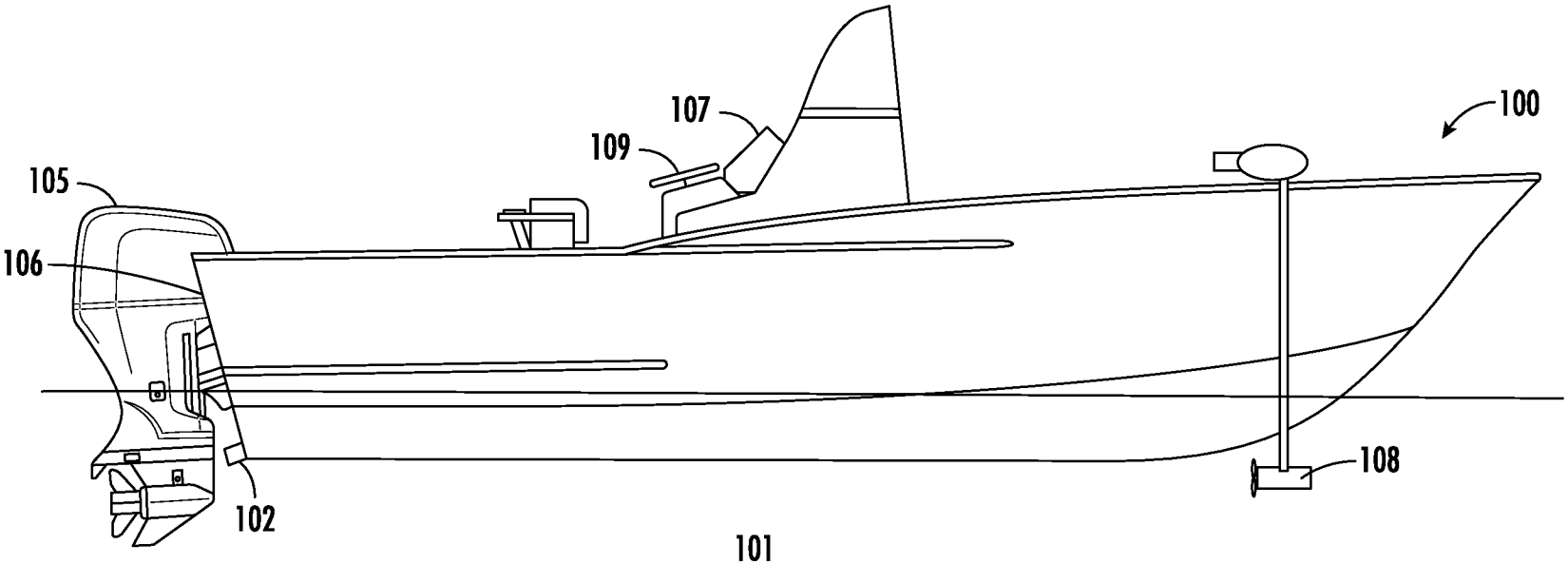
FIG. 1 shows an example watercraft, in accordance with some embodiments described herein.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As depicted in FIG. 1, a watercraft 100 (e.g., a vessel) configured to traverse a marine environment, e.g., body of water 101, may have one or more stabilization mechanisms, such as trim tabs 102 (additional example stabilization mechanisms are shown in other figures and described herein), disposed on and/or proximate to the watercraft. The watercraft 100 may be a surface watercraft, a submersible watercraft, or any other implementation known to those skilled in the art. The one or more stabilization mechanisms may each be configured to help stabilize the watercraft 100 in response to events such as waves, wind, etc.

The watercraft 100 may also include one or more marine electronic devices 107, such as may be utilized by a user to interact with, view, or otherwise control various aspects of the watercraft and its various marine systems described herein. In the illustrated embodiment, the marine electronic device 107 is positioned proximate the helm (e.g., steering wheel) of the watercraft 100—although other places on the watercraft 100 are contemplated. Likewise, additionally or alternatively, a user's mobile device may include functionality of a marine electronic device.

Depending on the configuration, the watercraft 100 may include a main propulsion motor 105, such as an outboard or inboard motor. Additionally, the watercraft 100 may include a trolling motor 108 configured to propel the watercraft 100 or maintain a position. The motor 105 and/or the trolling motor 108 may be steerable using the steering wheel 109, or in some embodiments, the watercraft 100 may have an autopilot navigation assembly that is operable to steer the motor 105 and/or the trolling motor 108, when engaged. The autopilot navigation assembly may be connected to or within a marine electronic device 107, or it may be located anywhere else on the watercraft 100. Alternatively, it may be located remotely, or in other embodiments, the watercraft 100 may not have an autopilot navigation assembly at all.

Still referring to FIG. 1, the watercraft 100 may include one or more stabilization mechanisms such as trim tabs 102, which are mounted to the transom 106 of the watercraft 100. The watercraft 100 may additionally or alternatively, in other embodiments, include other stabilization mechanisms such as a gyro stabilizer, an interceptor, ballast tanks, and/or any other type of stabilization mechanism, as described in more detail herein. The one or more stabilization mechanisms on the watercraft 100 may be configured to provide forces to cause the watercraft to maintain a relative orientation with the body of water 101. For example, in some embodiments, the stabilization mechanisms may be configured to maintain the watercraft 10 (or a plane of the watercraft, such as corresponding to a floor of the watercraft) within a relative angle of a surface of the body of water 101. For example, the plane of the watercraft may correspond to a floor upon which a user of the watercraft would walk, and the plane may correspond to the plane of the top surface of the body of water when the water is completely calm. Notably, various embodiments contemplate maintaining the watercraft within any relative angle, but some example ranges include less than 45 degrees, less than 35 degrees, less than 30 degrees, less than 20 degrees, less than 18 degrees, less than 15 degrees, less than 12 degrees, less than 10 degrees, less than 8 degrees, less than 5 degrees, etc.

Figure 2:
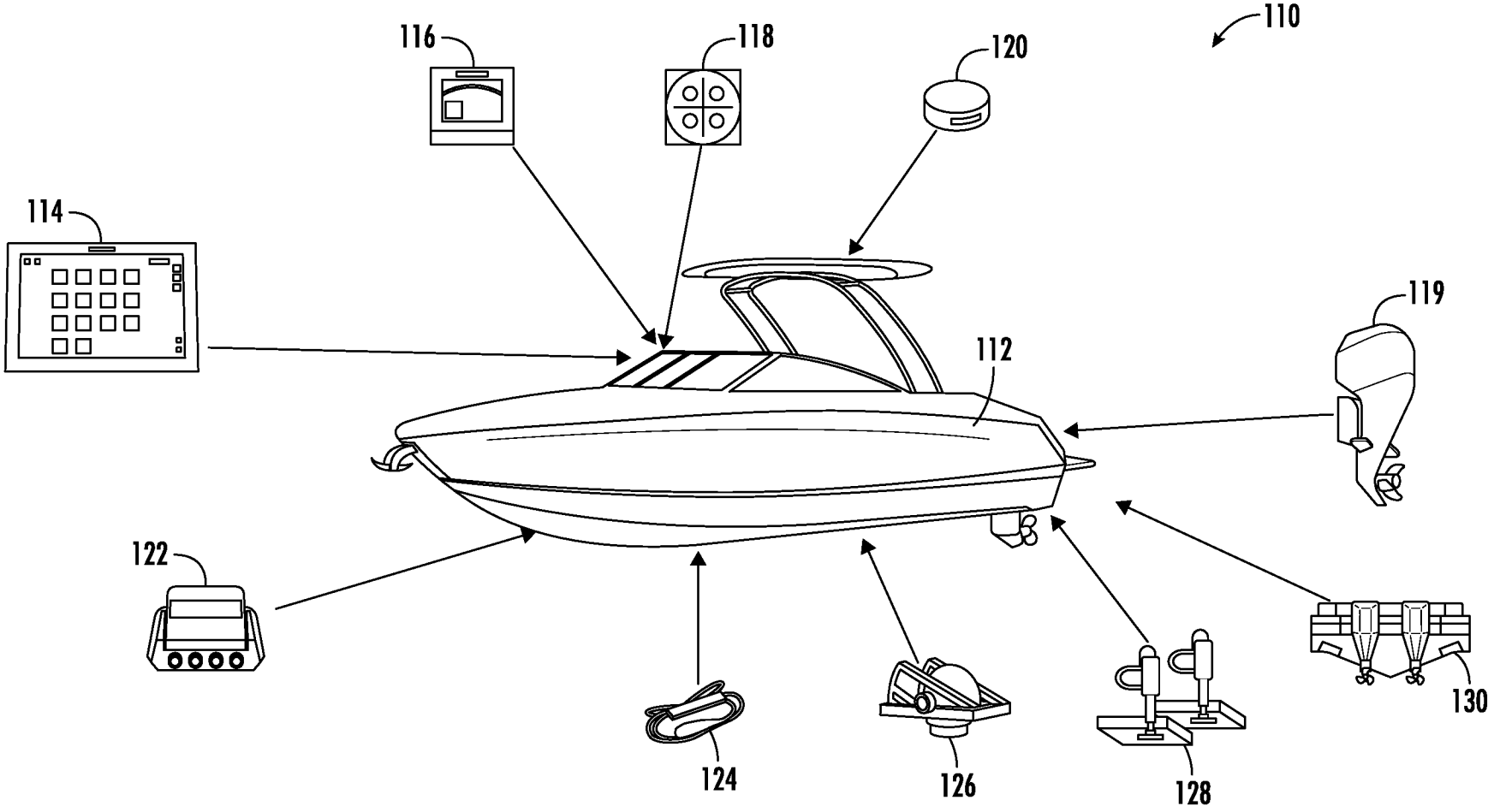
FIG. 2 is a diagram showing various example stabilization mechanisms and other systems on an example watercraft, in accordance with some embodiments discussed herein.

FIG. 2 is a diagram 110 that shows a watercraft 112 with callouts showing various elements (e.g., example stabilization mechanisms) that help stabilize the watercraft 112 in different ways. The marine electronic device 114 may be connected to one or all of the elements shown in FIG. 2, or the elements may be connected in another way, as will be described herein. The autopilot controller 116 is usable to control the navigation assembly 122 and therefore the motor 119. In some embodiments, the watercraft 112 may have a compass 120 that is connected to the navigation assembly 122. Although the autopilot controller 116 and the navigation assembly 122 are separate in the embodiment shown, the autopilot controller 116 and the navigation assembly 122 may be integrated in one element, in other embodiments. Further, in some other embodiments, the watercraft 112 may not even have one or both of the autopilot controller 116 and the navigation assembly 122.

Still referring to FIG. 2, the trim tab controller 118 is usable to control trim tabs 128 and/or interceptors 130. As will be described herein, the watercraft 112 may have one or both of the trim tabs 128 and the interceptors 130, and in embodiments in which the watercraft 112 has both, they may be controlled using the same or separate controllers. The watercraft 112 is also equipped with a gyro stabilizer 126, which may be controlled by a gyro stabilizer controller (not shown), such as one that is similar to trim tab controller 118. The gyro stabilizer 126, the trim tabs 128, the interceptors 130, and/or any other stabilization mechanisms may be in communication with the marine electronic device 114, or in some embodiments, they may be able to communicate directly with the navigation assembly 122 through a bridge device 124. That is, as will be described in more detail herein, the bridge device 124 may provide a way for the navigation assembly 122 to communicate with the stabilization mechanisms without using the marine electronic device 114.

Figure 3:
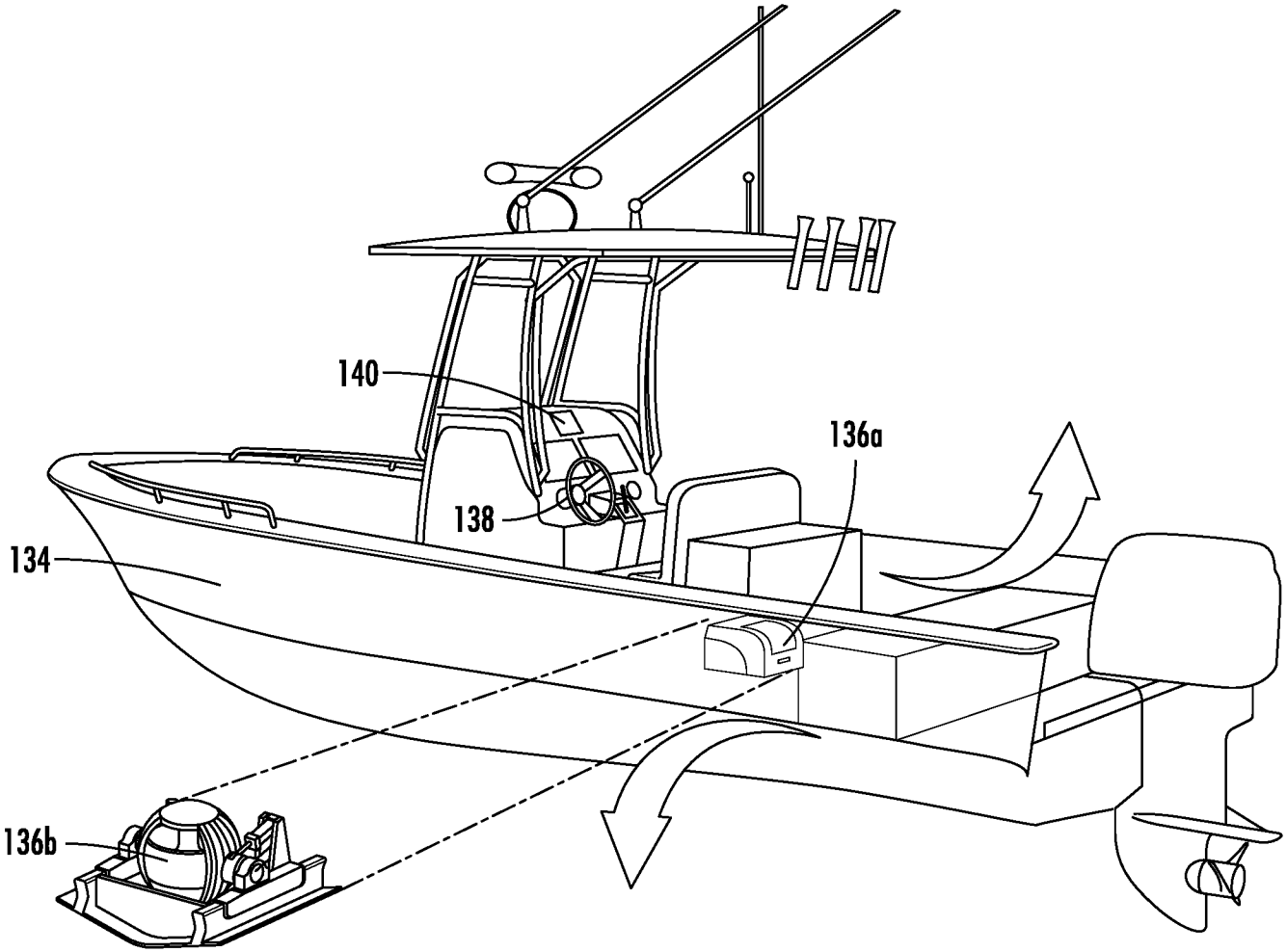
FIG. 3 shows an example watercraft with a gyro stabilizer, in accordance with some embodiments discussed herein.

FIG. 3 shows an example watercraft 134 with a gyro stabilizer **136*a* (shown also in the callout as 136*b*). The watercraft 134 has a steering wheel 138 and a marine electronic device 140 which, in some embodiments, are connected to and in communication with the gyro stabilizer 136*a*, 136*b*. The gyro stabilizer 136*a*, 136*b* is configured to, when unlocked, work as a gyroscope to provide a counter torque when the watercraft 134 is subject to external forces from, e.g., waves or wind. As shown in the callout, the gyro stabilizer 136*a*, 136*b* has a flywheel that spins quickly and provides the counter torque as it rocks back and forth. Ordinarily, for example, if the watercraft 134 were subject to external forces such as from wind or waves, the gyro stabilizer would provide the counter torque necessary to stabilize the watercraft 134. When the watercraft 134 turns, however, the watercraft 134 naturally rolls, and the gyro stabilizer 136***a*, 136*b* naturally fights against the natural roll of the watercraft 134 for the duration of the turn (when the gyro stabilizer is turned on).

Although the gyro stabilizer 136*a*, 136*b* is ordinarily helpful to stabilize the watercraft against forces such as from wind or waves, the use of the gyro stabilizer 136*a*, 136*b* may be problematic during a turn of the watercraft 134 because the natural roll or turn of the watercraft 134 during a turn is desirable and fighting against it with various stabilization mechanisms leads to inefficiencies (such as with respect to power/fuel consumption). Thus, even in windy and/or wavy conditions, it may be best for the gyro stabilizer 136*a*, 136*b* to be disengaged during a turn of the watercraft 134 (and then re-engaged after the turn is complete). Turning off the gyro stabilizer 136*a*, 136*b* manually is possible, but because a user has other tasks to complete before, during, and after a turn of the watercraft 134, it is often unrealistic. Thus, in most cases, users leave the gyro stabilizer 136*a*, 136*b* on during turns and let the gyro stabilizer 136*a*, 136*b* fight against the natural roll or turn of the watercraft 134. This can cause the watercraft to become damaged and/or use more energy than necessary. As will be described in more detail, the systems disclosed herein may cause the gyro stabilizer 136*a*, 136*b* to be disengaged during a turn of the watercraft 134 without the user having to necessarily turn it off manually.

Figure 4:
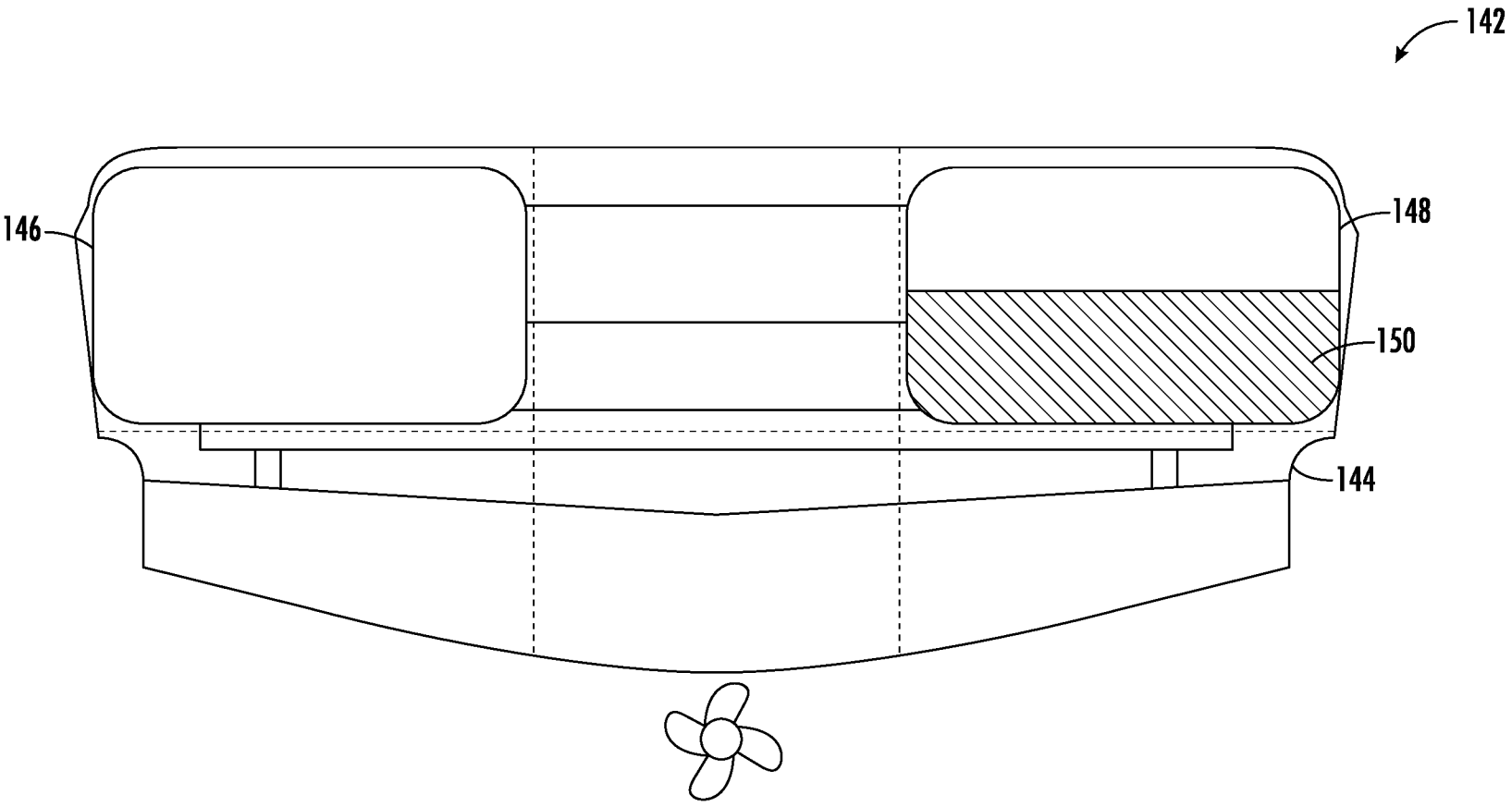
FIG. 4 shows an example watercraft with ballast tanks, in accordance with some embodiments discussed herein.

FIG. 4 shows an example watercraft 144 with ballast tanks 146 and 148. Ballast tanks are compartments within a watercraft that are used to hold selective amounts of fluid to provide hydrostatic stability for the watercraft. For example, in the embodiment shown, the starboard ballast tank 148 has been filled approximately halfway with fluid 150. The amount of fluid 150 may be calculated in response to an instability imposed on the watercraft 144. For example, if three people sit on the port side of the watercraft 144 (i.e., on the side of the watercraft 144 where the port ballast tank 146 is located), the ballast tank system 142 may calculate and pump an appropriate amount of fluid 150 into the starboard ballast tank 148 to counteract the force exerted by the three people (such as to maintain a desired orientation of the watercraft). Similarly, if the watercraft is traveling through a rough waterway in which it is being constantly thrust from the starboard side of the watercraft 144 with waves, a user of the watercraft 144 may decide to fill the starboard ballast tank 148 with a select amount of fluid 150 to give the watercraft 144 more stability against the crashing waves. The ballast tanks 146 and 148 may be useful in other situations as well to aid in stabilization of the watercraft 144 when the watercraft 144 is subject to external forces.

Although the ballast tanks 146 and 148 are ordinarily helpful to stabilize the watercraft, such as against from wind or waves, the use of the ballast tanks 146 and 148 may be problematic during a turn of the watercraft 144 because the natural roll or turn of the watercraft 144 during a turn is desirable. Thus, even in windy and/or wavy conditions, it may be best for the fluids in the ballast tanks 146 and 148 to be leveled out or otherwise adjusted during a turn of the watercraft 144 (and then re-adjusted after the turn is complete). For example, the starboard ballast tank 148 in FIG. 4 is filled with fluid 150 and port ballast tank 146 has no fluid. If the watercraft 144 were to make a turn in the port direction, the configuration with the fluid 150 in the starboard ballast tank 148 may fight against the turn and thus cause undue strain on the watercraft. Draining or adjusting the level of fluid in the ballast tanks 146 and 148 manually is possible, but because a user has other tasks to complete before, during, and after a turn of the watercraft 144, it is often unrealistic. Thus, in most cases, users leave the ballast tanks 146 and 148 as-is during turns and let the force from the fluid 150 in the ballast tank 148 fight against the natural roll or turn of the watercraft 144 in the port direction. As will be described in more detail, the systems disclosed herein may be configured to cause the fluid 150 to be drained from the starboard ballast tank 148 during a turn of the watercraft 134 without the user having to necessarily drain it manually. Further, in some embodiments, the systems disclosed herein may alternatively or additionally add fluid to the ballast tank 146. Further, in some embodiments, systems may be configured to determine that conditions are rough enough such that more fluid is needed in ballast tank 148 to stabilize the watercraft during a turn in the port direction (e.g., in some conditions in which waves surrounding the boat are rough enough, the starboard side of the watercraft 144 may need to be weighed down during a turn in the port direction so as to prevent the watercraft from capsizing).

Figure 5B:
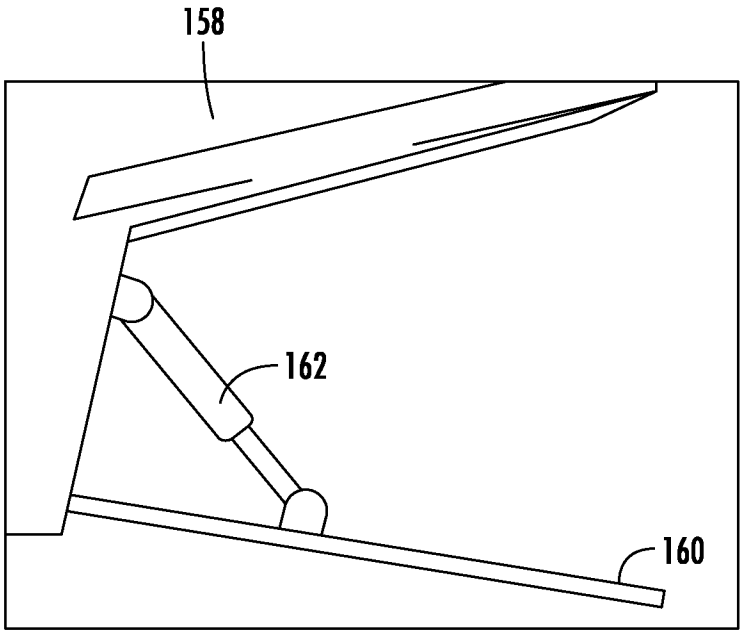
FIG. 5B shows an example watercraft with trim tabs, in accordance with some embodiments discussed herein.
Figure 5A:
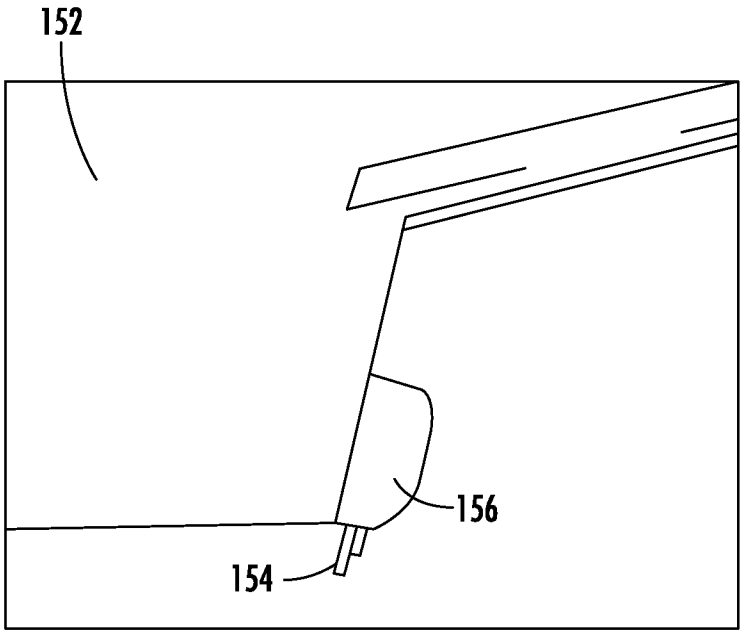
FIG. 5A shows an example watercraft with an interceptor, in accordance with some embodiments discussed herein.

FIG. 5A shows a zoomed-in view of the transom of a watercraft 152, on which an interceptor has been mounted. The interceptor shown in FIG. 5A is on a port side of the transom of the watercraft 152. Although not shown, the watercraft 152 has another interceptor on a starboard side of the transom of the watercraft 152 that is similarly configured. The interceptor shown in FIG. 5A has an interceptor housing 156 and a blade 154. The blade 154 is configured to move down into water beneath the watercraft 152, usually while the watercraft 152 is moving, to create a pressure differential that causes the back portion of the watercraft 152 to move up out of the water (and thus causes the bow of the watercraft 152 to move down further into the water). This is useful, e.g., when a user is increasing the speed of the watercraft 152 to cause the watercraft 152 to more quickly achieve an "on plane" orientation (e.g., cause the watercraft to travel on top of the surface of the body of water). Further, since watercraft typically have at least two interceptors, the interceptors can be lowered to different depths such that the bow is lifted in a desired direction. This is useful for leveling the watercraft 152 and preventing the watercraft 152 from unnecessarily rolling from side to side. For example, interceptors may be used when multiple people are sitting on one side of the watercraft 152 and no one is sitting on the other side of the watercraft 152. That is, if three people are sitting on the port side of the watercraft 152 and no one is sitting on the starboard side of the watercraft 152, lowering the interceptor on the port side of the watercraft 152 (and/or raising the trim tab on the starboard side of the watercraft 152) may help level out the watercraft 152.

Although interceptors are ordinarily useful to help the watercraft 152 more quickly achieve an "on plane" orientation and/or to stabilize the watercraft 152 against forces such as from unbalanced loads, wind, or waves, the use of interceptors may be problematic during a turn of the watercraft 152 because the natural roll or turn of the watercraft during a turn is desirable. Thus, even in windy and/or wavy conditions, it may be best for the interceptors to be retracted or otherwise adjusted during a turn of the watercraft 152 (and then, for example, re-adjusted after the turn is complete). For example, both interceptors may be lowered to a same depth into the water beneath the watercraft 152 to help the watercraft 152 more quickly achieve an "on plane" orientation. If the watercraft 152 were to make a turn in the port direction, the port interceptor may fight against the turn and thus cause undue strain on both the port interceptor and the watercraft itself. Retracting the port interceptor manually is possible, but because a user has other tasks to complete before, during, and after a turn of the watercraft 152, it is often unrealistic. Thus, in most cases, users leave the interceptors as-is during turns and let the force from the interceptors fight against the natural roll or turn of the watercraft 152. As will be described in more detail, the systems disclosed herein may be configured to cause the port interceptor to be retracted or otherwise adjusted during a turn of the watercraft 152 in the port direction without the user having to necessarily adjust it manually. Further, in some embodiments, the systems disclosed herein may alternatively or additionally adjust the starboard interceptor to assist with the turn of the watercraft 152 by intentionally lowering the starboard interceptor down into the water during the turn in the port direction.

FIG. 5B shows a zoomed-in view of the transom of a watercraft 158, on which a trim tab has been mounted. The trim tab shown in FIG. 5B is on a port side of the transom of the watercraft 158. Although not shown, the watercraft 158 has another trim tab on a starboard side of the transom of the watercraft 158 that is similarly configured. The trim tab shown in FIG. 5B has an actuator 162 and a plate 160 attached to the actuator 162. The actuator 162 is configured to lower the plate 160 down into water beneath the watercraft 158, usually while the watercraft 158 is moving, to create a pressure differential that causes the back portion of the watercraft 158 to move up out of the water (and thus causes the bow of the watercraft 158 to move down further into the water). This is useful, e.g., when a user is increasing the speed of the watercraft 158 to cause the watercraft 158 to more quickly achieve an "on plane" orientation (e.g., cause the watercraft to travel on top of the surface of the body of water). Further, since watercraft typically have at least two trim tabs, the trim tabs can be lowered to different angles such that the bow is lifted in a desired direction. This is useful for leveling the watercraft 158 and preventing the watercraft 158 from unnecessarily rolling from side to side. For example, trim tabs may be used when multiple people are sitting on one side of the watercraft 158 and no one is sitting on the other side of the watercraft 158. That is, if three people are sitting on the port side of the watercraft 158 and no one is sitting on the starboard side of the watercraft 158, lowering the trim tab on the port side of the watercraft 158 (and/or raising the trim tab on the starboard side of the watercraft 158) may help level out the watercraft 158.

Although trim tabs are ordinarily useful to help a watercraft more quickly achieve an "on plane" orientation and/or to stabilize the watercraft against forces such as from unbalanced loads, wind, or waves, the use of trim tabs may be problematic during a turn of the watercraft because the natural roll or turn of the watercraft during a turn is desirable. Thus, even in windy and/or wavy conditions, it may be best for the trim tabs to be retracted or otherwise adjusted during a turn of the watercraft (and then, for example, re-adjusted after the turn is complete).

Figure 6:
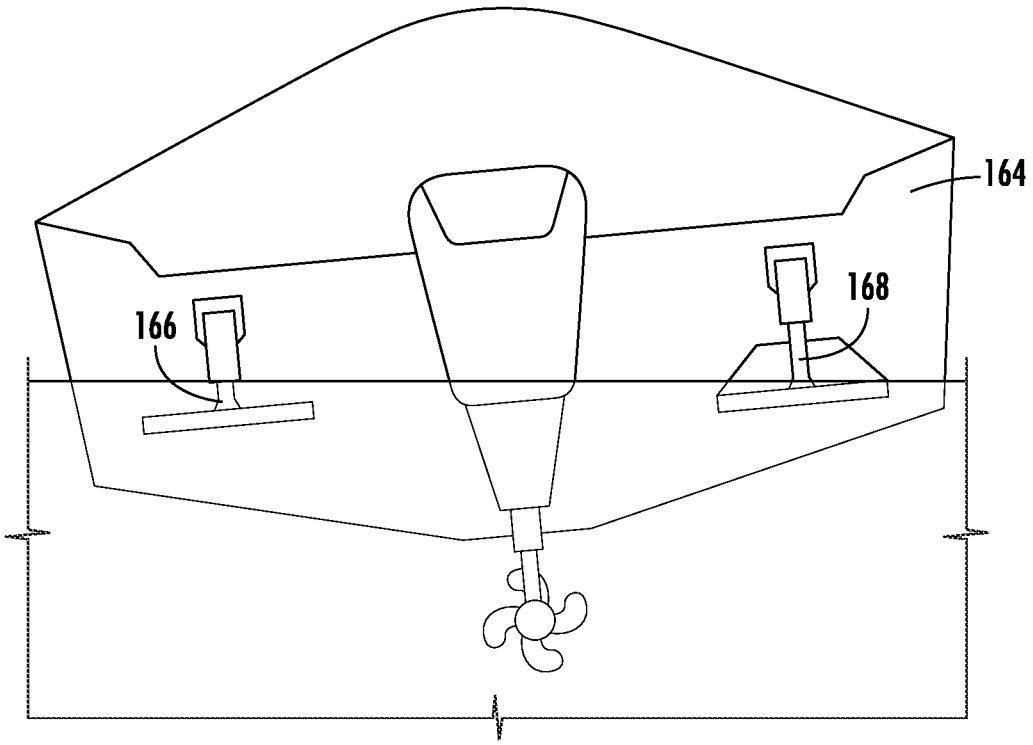
FIG. 6 shows another example watercraft with trim tabs, in accordance with some embodiments discussed herein.

For example, FIG. 6 shows a watercraft 164 with trim tabs 166 and 168 disposed on the transom of the watercraft 164. The port trim tab 166 is trimmed up and thus disengaged, and the starboard trim tab 168 is trimmed down and thus engaged. This trim tab configuration may be employed, for example, in a situation in which three people are sitting on the starboard side of the watercraft 164. If the watercraft 164 were to make a turn in the starboard direction, the starboard trim tab 168 would fight against the turn and thus cause undue strain on both the starboard trim tab 168 and the watercraft 164 itself. Retracting the starboard trim tab 168 manually is possible, but because a user has other tasks to complete before, during, and after a turn of the watercraft 164, it is often unrealistic. Thus, in most cases, users leave the trim tabs 166 and 168 as-is during turns and let the force from the trim tabs 166 and 168 fight against the natural roll or turn of the watercraft 164. As will be described in more detail, the systems disclosed herein may be configured to cause the starboard trim tab 168 to be retracted or otherwise adjusted during a turn of the watercraft 164 in the starboard direction without the user having to necessarily adjust it manually. Further, in some embodiments, the systems disclosed herein may alternatively or additionally adjust the port trim tab 166 to assist with the turn of the watercraft 164 by intentionally lowering the port trim tab 166 down into the water during the turn in the starboard direction.

Alternatively, if the watercraft 164 shown in FIG. 6 makes a turn in the port direction, the configuration shown in which the port trim tab 166 is raised and the starboard trim tab 168 is lowered into the water may be such that the roll of the watercraft 164 during the turn is more than comfortable (e.g., more than necessary). In that case, the systems described herein may be configured to adjust the trim tab 168 such that it remains lowered, but at a lower angle, such that the starboard trim tab 168 optimally assists with the turn of the watercraft 164 in the port direction.

It should be appreciated that one, more, or all of the mechanisms shown in the preceding figures can be included on a single watercraft, and in some embodiments, they may be programmed to work together such that an optimum overall stabilizing force is applied to the watercraft during a turn. Additionally, the systems described herein may incorporate other stabilization mechanisms as well, including those not described herein. For example, another stabilization mechanism that may be used in the systems and methods described herein is fin stabilizers.

Figure 7:
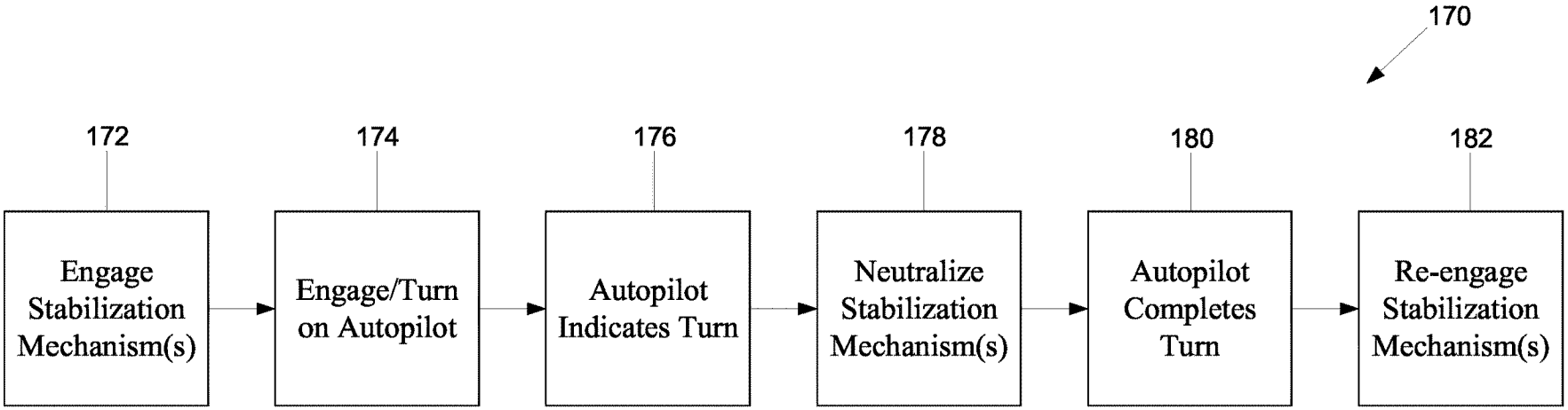
FIG. 7 is a flowchart of an example method for neutralizing stabilization mechanisms on a watercraft during a period of time corresponding to a turn of the watercraft, where the autopilot is in control of the watercraft, in accordance with some embodiments discussed herein.

FIGS. 7-10 are flowcharts showing various example methods for neutralizing and adjusting various stabilization mechanisms on a watercraft in response to a detection of a turn. FIG. 7 is a flowchart of a method 170 for neutralizing stabilization mechanism(s) on a watercraft in response to a turn that is detected by an autopilot navigation assembly. The method 170 includes, at operation 172, engaging one or more stabilization mechanisms on a watercraft. The operation 172 may include, for example, turning on a gyro stabilizer and lowering one or both of a pair of trim tabs to a desired position. The method 170 may then include, at operation 174, engaging and/or turning on an autopilot navigation assembly. The autopilot navigation assembly may, when engaged and/or turned on, operate to guide and steer the watercraft through an environment. At operation 176, the method 170 may include the autopilot navigation assembly indicating a turn. Because the autopilot navigation assembly pre-determines a route for the watercraft and then subsequently executes that route, the autopilot navigation assembly can indicate that a turn is about to occur before it actually sends a turn signal to the motor, and thus before the watercraft actually begins to turn. The system may then include at operation 178 neutralizing the stabilization mechanism(s) on the watercraft, and then at operation 180, the autopilot navigation assembly may send a signal to the motor to turn the watercraft. Once the signal has been sent and the watercraft turns, and, in some embodiments, after the turn has been completed and the motor has returned to a non-turning position, the method 170 may include re-engaging the stabilization mechanism(s) on the watercraft at operation 182. For example, in the example in which the watercraft has a trim tab system and a gyro stabilizer that are engaged at operation 172, the method 170 may then turn on the autopilot navigation assembly at 174, which may then indicate a turn at operation 176. The method 170 may then turn the gyro stabilizer off and raise the trim tabs to a neutral position at operation 178 until the turn has been completed at operation 180. The method 170 may then lower the trim tabs to their previous positions and turn the gyro stabilizer back on at operation 182.

Figure 8:
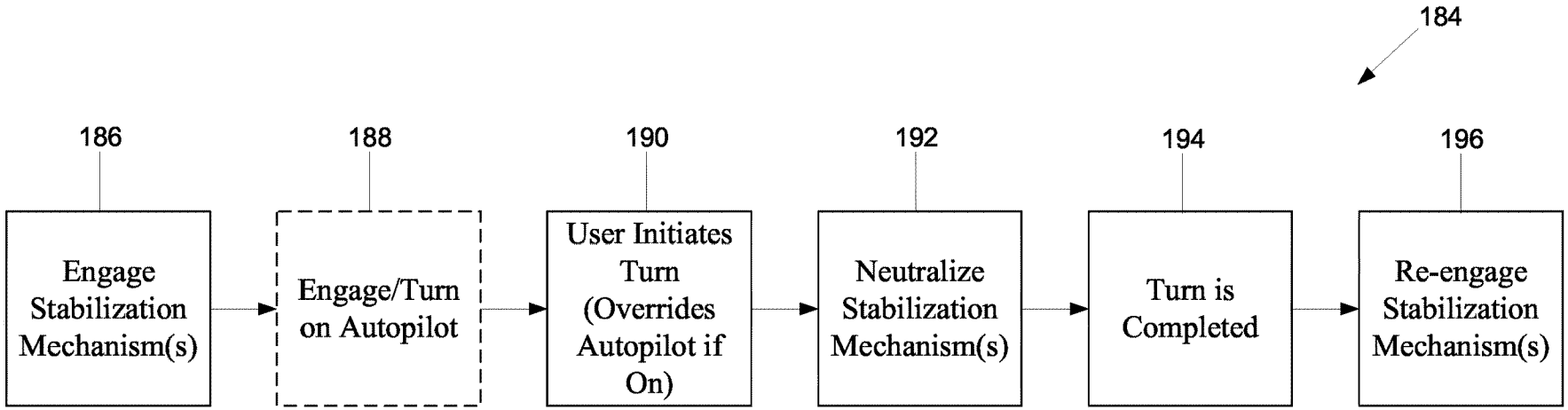
FIG. 8 is a flowchart of another example method for neutralizing stabilization mechanisms on a watercraft during a period of time corresponding to a turn of the watercraft, where the turn is initiated by the user, in accordance with some embodiments discussed herein.

FIG. 8 is a flowchart of a method 184 for neutralizing stabilization mechanism(s) on a watercraft in response to a turn that is detected by a turning of a steering wheel on the watercraft (such as by a user directly engaging with the steering wheel). The method 184 includes, at operation 186, engaging one or more stabilization mechanisms on a watercraft. The operation 186 may include, for example, turning on a gyro stabilizer and lowering one or both of a pair of trim tabs to a desired position. The method 184 may then optionally include, at operation 188, engaging and/or turning on an autopilot navigation assembly. The autopilot navigation assembly may, when engaged and/or turned on, operate to guide and steer the watercraft through an environment. Alternatively, in embodiments in which there is no autopilot navigation assembly or in which the autopilot navigation assembly is not turned on, a user may navigate the watercraft by simply steering the steering wheel. At operation 190, the method 184 may determine that a user initiated a turn. When the turn is initiated at operation 190, the autopilot navigation assembly is overridden (if it is on/engaged). As an example, the watercraft may be equipped with a sensor on or connected to a steering wheel of the watercraft to detect movement or turning of the steering wheel. The method 184 may be configured to determine that a turn has begun at operation 190 when the wheel has been detected to turn more than a certain threshold degrees, such as 2 degrees, 5 degrees, 10 degrees, 15 degrees, 20 degrees, 35 degrees, etc. Further, the method 184 may also be configured to override the autopilot navigation assembly when the steering wheel has been detected to turn more than a certain threshold degrees, such as 2 degrees, 5 degrees, 10 degrees, 15 degrees, 20 degrees, 35 degrees, etc. This may occur, for example, in a situation in which the user suddenly decides to turn the watercraft around to retrieve something in the water. In such a case, the method 184 detects at operation 190 that a turn has been initiated when the user grabs and turns the steering wheel, and it would override the autopilot navigation assembly if it had been turned on prior to that. The system may then include, at operation 192, neutralizing the stabilization mechanism(s) on the watercraft, and then, at operation 194, the user may complete the turn. The turn is complete when the steering wheel is detected to be returned to a neutral position (e.g., a position that causes the watercraft to travel in a direction that is substantially straight forward). Once the turn has been completed and the steering wheel has returned to a non-turning position, the method 184 may include re-engaging the stabilization mechanism(s) on the watercraft at operation 196. For example, in the example in which the watercraft has a trim tab system and a gyro stabilizer that are engaged at operation 186, the method 184 may then optionally turn on the autopilot navigation assembly at 188. At operation 190, the method 184 may then detect that a user has indicated a turn, and the autopilot navigation assembly would be overridden if it were turned on at operation 188. The method 184 would then turn the gyro stabilizer off and raise the trim tabs to a neutral position at operation 192 until the turn has been completed at operation 194. The method 184 may then lower the trim tabs to their previous positions and turn the gyro stabilizer back on at operation 196.

Figure 9:
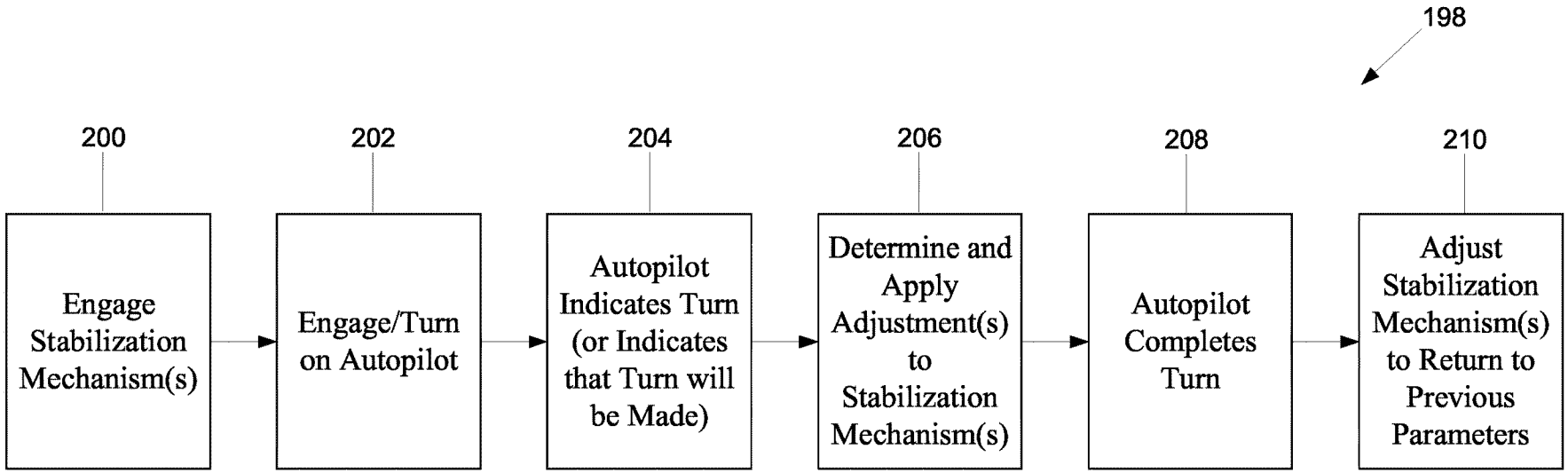
FIG. 9 is a flowchart of an example method for adjusting stabilization mechanisms on a watercraft during a period of time corresponding to a turn of the watercraft, where the autopilot is in control of the watercraft, in accordance with some embodiments discussed herein.

FIG. 9 is a flowchart of a method 198 for adjusting stabilization mechanism(s) on a watercraft in response to a turn that is detected by an autopilot navigation assembly. The method 198 includes, at operation 200, engaging one or more stabilization mechanisms on a watercraft. The operation 200 may include, for example, turning on a gyro stabilizer and lowering one or both of a pair of trim tabs to a desired position. The method 198 may then include, at operation 202, engaging and/or turning on an autopilot navigation assembly. The autopilot navigation assembly may, when engaged and/or turned on, operate to guide and steer the watercraft through an environment. At operation 204, the method 198 may include the autopilot navigation assembly indicating a turn. Because the autopilot navigation assembly pre-determines a route for the watercraft and then subsequently executes that route, the autopilot navigation assembly can indicate that a turn is about to occur before it actually sends a turn signal to the motor, and thus before the watercraft actually begins to turn (although the autopilot may simply indicate the turn as it is being initiated). The system may then include at operation 206 determining and applying an adjustment (or adjustments) to the stabilization mechanism(s) on the watercraft, and then at operation 208, the autopilot navigation assembly may send a signal to the motor to turn the watercraft. Once the signal has been sent and the watercraft turns, and after the turn has been completed and the motor has returned to a non-turning position, the method 198 may include re-adjusting the stabilization mechanism(s) on the watercraft to return to their previous parameters at operation 210. For example, in the example in which the watercraft has a trim tab system and a gyro stabilizer that are engaged at operation 200, the method 198 may then turn on the autopilot navigation assembly at 202, which may then indicate a turn at operation 204. The method 198 would then determine and apply adjustments to each of the gyro stabilizer and the trim tabs at operation 206 until the turn has been completed at operation 208. The method 198 may then re-adjust the trim tabs and the gyro stabilizer back to their previous parameters at operation 210.

In some embodiments, the adjustment determined and applied at operation 206 may be calculated proportionately when more than one stabilization mechanism is involved. For example, in the example in which the watercraft has a trim tab system and a gyro stabilizer that are engaged at operation 200, the adjustments that are determined to be applied to each of the gyro stabilizer and the trim tabs may be calculated proportionately. That is, the method 198 may use data from the autopilot navigation assembly and/or data from sensors on the watercraft to determine a numerical value of instability such as a tilt angle (or a predicted maximum tilt angle) of the watercraft for the duration of the turn. The numerical value of instability (e.g., the tilt angle) may then be used to determine the adjustment values to be applied to the gyro stabilizer and the trim tabs. In situations in which the tilt value is small, for example, the method 198 may determine that the gyro stabilizer should be turned off, that the starboard trim tab should be lowered, such as to 2 degrees (or other values), and that the port trim tab should be raise to a neutral position. In situations in which the tilt value is larger, however, the method 198 may determine that the gyro stabilizer should be turned off, that the starboard trim tab should be lowered to, for example, 15 degrees, and that the port trim tab should be raise to a neutral position.

Figure 10:
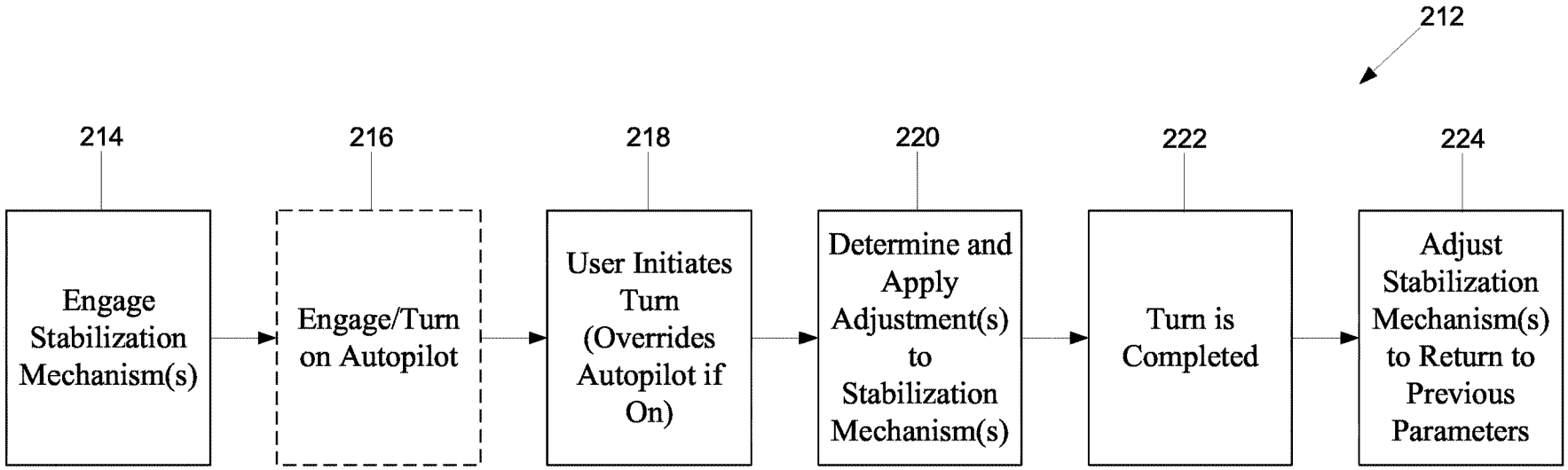
FIG. 10 is a flowchart of another example method for adjusting stabilization mechanisms on a watercraft during a period of time corresponding to a turn of the watercraft, where the turn is initiated by the user, in accordance with some embodiments discussed herein.

FIG. 10 is a flowchart of a method 212 for adjusting stabilization mechanism(s) on a watercraft in response to a turn that is detected by a turning of a steering wheel on the watercraft. The method 212 includes, at operation 214, engaging one or more stabilization mechanisms on a watercraft. The operation 214 may include, for example, turning on a gyro stabilizer and lowering one or both of a pair of trim tabs to a desired position. The method 212 may then optionally include, at operation 216, engaging and/or turning on an autopilot navigation assembly. The autopilot navigation assembly may, when engaged and/or turned on, operate to guide and steer the watercraft through an environment. Alternatively, in embodiments in which there is no autopilot navigation assembly or in which the autopilot navigation assembly is not turned on, a user may navigate the watercraft by simply steering the steering wheel. At operation 218, the method 212 may include determining that a user initiated a turn. When the turn is initiated at operation 218, the autopilot navigation assembly is overridden (if it is on/engaged). As an example, the watercraft may be equipped with a sensor on or connected to a steering wheel of the watercraft to detect movement or turning of the steering wheel. The method 212 may be configured to determine that a turn has begun at operation 218 when the wheel has been detected to turn more than a certain threshold degrees, such as 2 degrees, 5 degrees, 10 degrees, 15 degrees, 20 degrees, 35 degrees, etc. Further, the method 212 may also be configured to override the autopilot navigation assembly when the steering wheel has been detected to turn more than a certain threshold degrees, such as 2 degrees, 5 degrees, 10 degrees, 15 degrees, 20 degrees, 35 degrees, etc. This may occur, for example, in a situation in which the user suddenly decides to turn the watercraft around to retrieve an item in the water. In such a case, the method 212 may detect at operation 218 that a turn has been initiated when the user grabs and turns the steering wheel, and it would override the autopilot navigation assembly if it had been turned on prior to that. The system may then include at operation 220 determining and applying an adjustment (or adjustments) to the stabilization mechanism(s) on the watercraft, and then at operation 222, user may complete the turn. The turn is complete, for example, when the steering wheel is detected to be returned to a neutral position (e.g., a position that causes the watercraft to travel in a direction that is substantially straight forward). Once the turn has been completed and the steering wheel has returned to a non-turning position, the method 212 may include re-adjusting the stabilization mechanism(s) on the watercraft to return to their previous parameters at operation 224. For example, in the example in which the watercraft has a trim tab system and a gyro stabilizer that are engaged at operation 214, the method 212 may then optionally turn on the autopilot navigation assembly at 216. At operation 218, the method 212 may then detect that a user has indicated a turn, and the autopilot navigation assembly would be overridden if it were turned on at operation 216. The method 212 would then determine and apply adjustments to each of the gyro stabilizer and the trim tabs at operation 220 until the turn has been completed at operation 222. The method 212 may then re-adjust the trim tabs and the gyro stabilizer back to their previous parameters at operation 224.

The adjustment determined and applied at operation 220 may be calculated proportionately when more than one stabilization mechanism is involved. For example, in the example in which the watercraft has a trim tab system and a gyro stabilizer that are engaged at operation 214, the adjustments that are determined to be applied to each of the gyro stabilizer and the trim tabs may be calculated proportionately. That is, the method 212 may use data from sensors on the watercraft to determine a numerical value of instability of the watercraft, such as a tilt angle. The numerical value of instability (e.g., the tilt angle) may then be used to determine the adjustment values to be applied to the gyro stabilizer and the trim tabs. In situations in which the tilt value is small, for example, the method 212 may determine that the gyro stabilizer should be turned off, that the starboard trim tab should be lowered, such as to 2 degrees (or other values), and that the port trim tab should be raise to a neutral position. In situations in which the tilt value is larger, however, the method 212 may determine that the gyro stabilizer should be turned off, that the starboard trim tab should be lowered to, for example, 15 degrees, and that the port trim tab should be raise to a neutral position.

It should be appreciated that, in some embodiments, the operations within the methods shown in FIGS. 7-10 may be executed in any other order. In some other embodiments, certain operations within the methods shown in FIGS. 7-10 may be optional or omitted entirely. Further, in some embodiments, the methods shown in FIGS. 7-10 may contain additional operations other than those shown. For example, instead of the method including detecting a turn of the watercraft by receiving information from an autopilot navigation assembly or from a sensor indicating that the steering wheel has been turned, the method may include, in other embodiments, receiving information from a navigation assembly that is following a predetermined navigation route. In such embodiments, the navigation assembly would indicate that the watercraft is predicted to make a turn based on the predetermined navigation route that is being followed, and the system may make adjustments to the stabilization mechanism(s) on the watercraft accordingly. In other embodiments, the systems may be configured in any other way.

Figure 11:
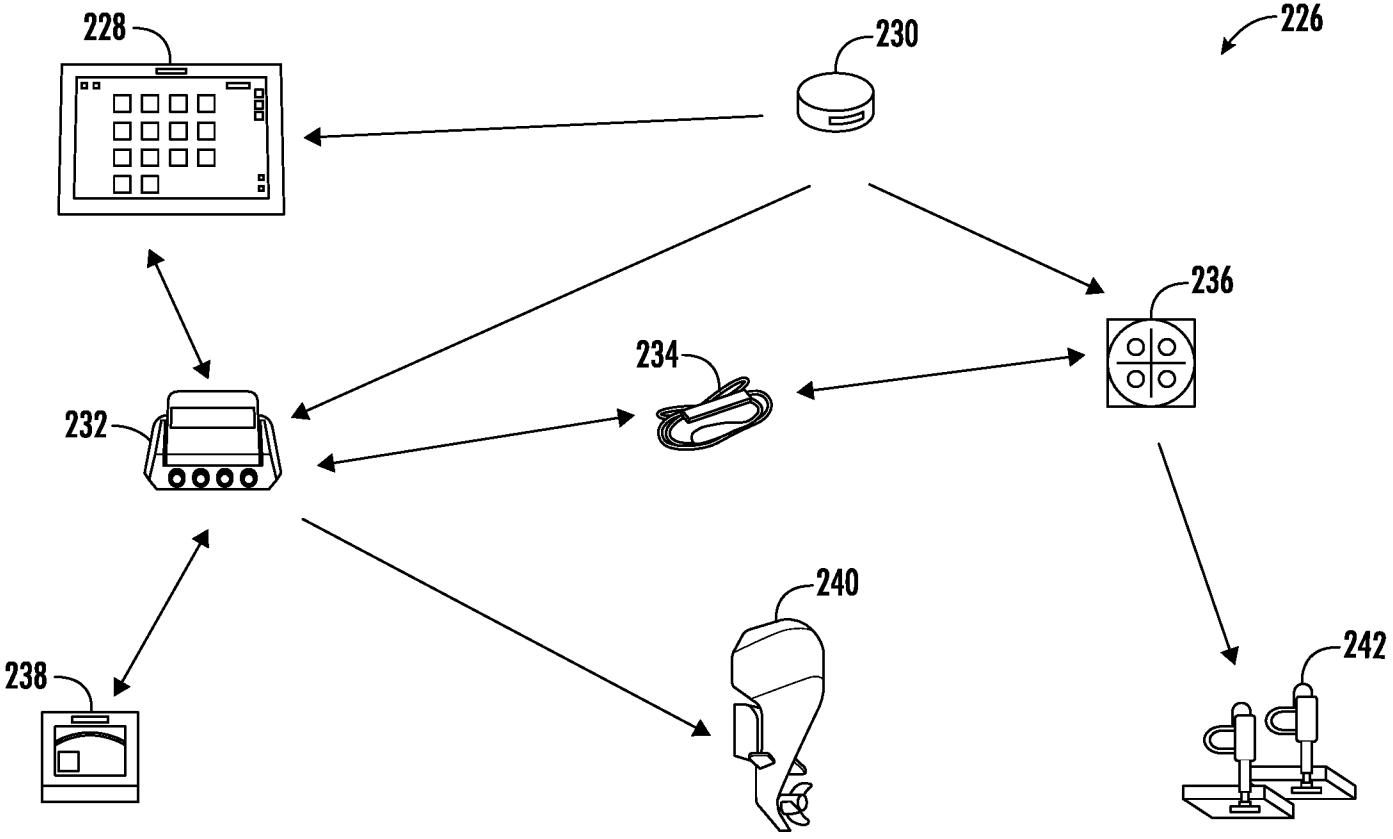
FIG. 11 is a diagram showing example relationships between stabilization mechanisms and other elements on a watercraft, in accordance with some embodiments discussed herein.

FIG. 11 is a diagram showing relationships between various elements that may be included in a stabilization system 226 for a watercraft. The system 226 may include a marine electronic device 228 that is optionally in communication with a compass 230 and/or a navigation assembly 232. The navigation assembly 232 may include either one or both of an autopilot assembly and a user steering assembly. The navigation assembly 232 may optionally be in communication with the compass 230, a motor 240, and an autopilot controller 238. The navigation assembly 232 may also be optionally in communication with a stabilization system controller 236 through a bridge device 234. The stabilization system controller 236 may be a trim tab controller, an interceptor controller, a gyro stabilizer controller, a ballast tank controller, any other controller, or any combination thereof. In the embodiment shown in FIG. 11, the stabilization system controller is connected at least to a pair of trim tabs 242. The bridge device 234 provides a communication pathway between the navigation assembly 232 and the stabilization system controller 236 that does not necessarily involve the marine electronic device 228. That is, the bridge device 234 allows the navigation assembly 232 and the stabilization system controller 236 to communicate directly. This is useful in a moment in which the system 226 determines that the watercraft is about to make or is beginning to make a turn, because it allows the system 226 to more quickly make the neutralizations and/or adjustments to the stabilization mechanisms on the watercraft for the duration of the turn.

Example System Architecture

Figure 12:
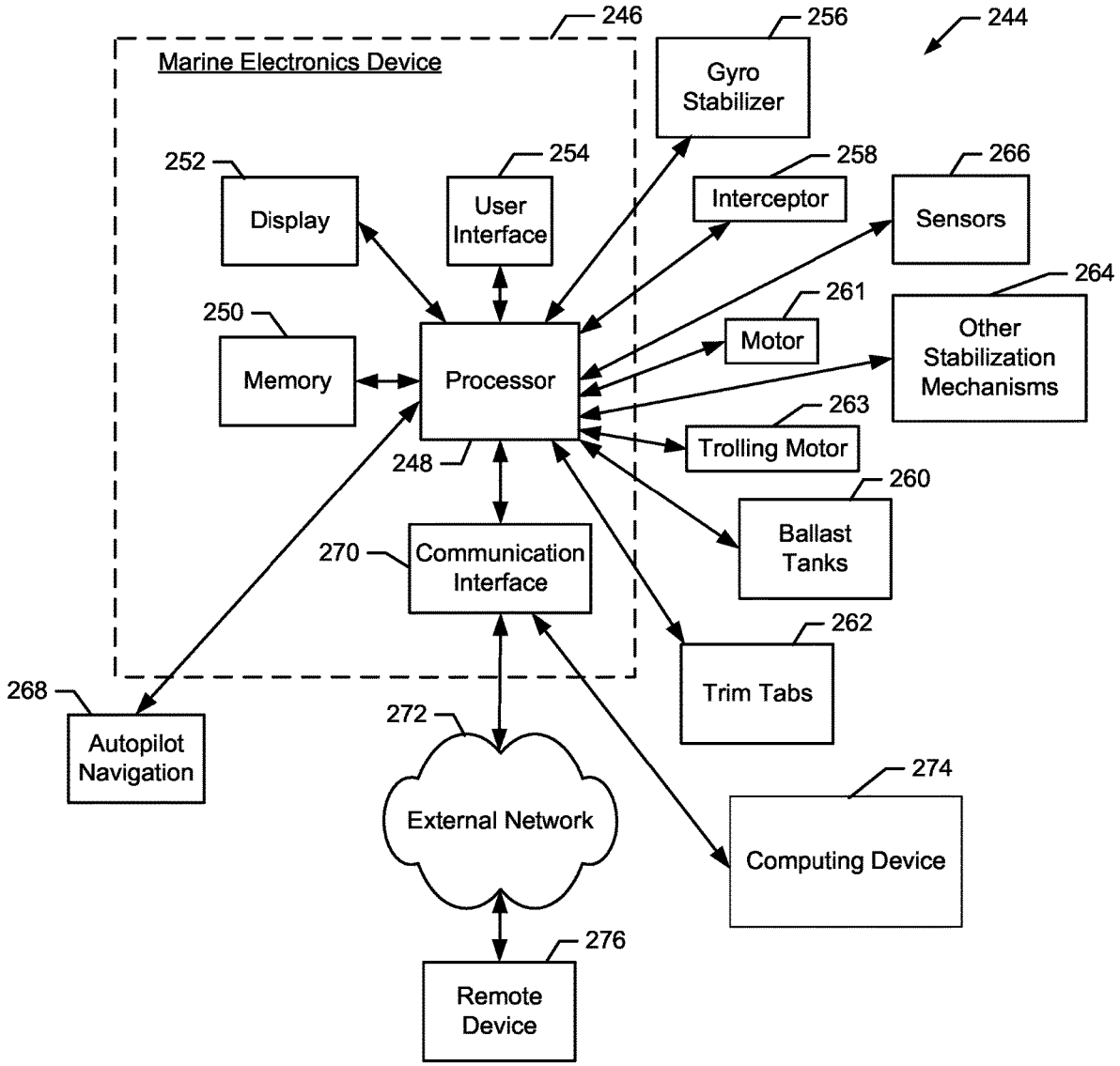
FIG. 12 is a block diagram of an example system, in accordance with some embodiments discussed herein.

FIG. 12 shows a block diagram of an example system 244 capable for use with several embodiments of the present disclosure. As shown, the system 244 may include a number of different modules or components, each of which may comprise any device or means embodied in either hardware, software, or a combination of hardware and software configured to perform one or more corresponding functions. For example, the system 244 may include a marine electronics device 246 (e.g., controller) and various sensors/system.

The marine electronics device 246, controller, remote control, MFD, and/or user interface display may include a processor 248, a memory 250, a communication interface 270, a user interface 254, and a display 252. The processor 248 may be in communication with one or more devices such as gyro stabilizer 256, interceptors 258, ballast tanks 260, trim tabs 262, sensors 266, and/or other stabilization mechanisms 264 to neutralize or adjust stabilization parameters for a duration of a turn of the watercraft. For example, the sensors 266 or the autopilot navigation 268 may communicate to the processor 248 that the watercraft is about to make a turn or that the watercraft has begun to make a turn, and the processor 248 may then send signals to either neutralize or adjust one or more of the gyro stabilizer 256, interceptors 258, ballast tanks 260, trim tabs 262, and/or other stabilization mechanisms 264 for the duration of the turn.

In some embodiments, the system 244 may be configured to receive, process, and display various types of marine data. In some embodiments, the system 244 may include one or more processors 248 and a memory 250. Additionally, the system 244 may include one or more components that are configured to gather marine data or perform marine features. In such a regard, the processor 248 may be configured to process the marine data for various functionality described herein. Further, the system 244 may be configured to communicate with various internal or external components (e.g., through the communication interface 270), such as to provide instructions related to the marine data.

The processor 248 may be any means configured to execute various programmed operations or instructions stored in a memory, such as a device and/or circuitry operating in accordance with software or otherwise embodied in hardware or a combination thereof (e.g., a processor operating under software control, a processor embodied as an application specific integrated circuit (ASIC) or field programmable gate array (FPGA) specifically configured to perform the operations described herein, or a combination thereof) thereby configuring the device or circuitry to perform the corresponding functions of the processor 248 as described herein. In this regard, the processor 248 may be configured to analyze electrical signals communicated thereto to, e.g., determine an adjustment for one or more stabilization mechanisms on the watercraft such as for the gyro stabilizer 256, interceptors 258, ballast tanks 260, and/or trim tabs 262.

The memory 250 may be configured to store instructions, computer program code, marine data, and/or other data associated with the system 244 in a non-transitory computer readable medium for use by the processor, for example.

The system 244 may also include one or more communications modules configured to communicate via any of many known manners, such as via a network, for example. The processing circuitry and communication interface 270 may form a processing circuitry/communication interface. The communication interface 270 may be configured to enable connections to external systems (e.g., an external network 272 or one or more remote controls, such as a handheld remote control, marine electronics device, foot pedal, or other remote computing device). In this regard, the communication interface (e.g., 270) may include one or more of a plurality of different communication backbones or frameworks, such as Ethernet, USB, CAN, NMEA 2000, GPS, Sonar, cellular, WiFi, and/or other suitable networks, for example. In this manner, the processor 248 may retrieve stored data from a remote, external server via the external network 272 in addition to or as an alternative to the onboard memory 250. The network may also support other data sources, including GPS, autopilot, engine data, compass, radar, etc. Numerous other peripheral, remote devices such as one or more wired or wireless multi-function displays may be connected to the system 244.

The processor 248 may configure the device and/or circuitry to perform the corresponding functions of the processor 248 as described herein. In this regard, the processor 248 may be configured to analyze electrical signals communicated thereto to provide, for example, various features/functions described herein.

The display 252 may be configured to display images and may include or otherwise be in communication with a user interface 254 configured to receive input from a user. The display 252 may be, for example, a conventional liquid crystal display (LCD), LED/OLED display, touchscreen display, mobile media device, and/or any other suitable display known in the art, upon which images may be displayed. In some embodiments, the display 252 may be the MFD and/or the user's mobile media device. The display may be integrated into the marine electronic device 246. In some example embodiments, additional displays may also be included, such as a touch screen display, mobile media device, or any other suitable display known in the art upon which images may be displayed.

In some embodiments, the display 252 and/or user interface 254 may be a screen that is configured to merely present images and not receive user input. In other embodiments, the display and/or user interface may be a user interface such that it is configured to receive user input in some form. For example, the screen may be a touchscreen that enables touch input from a user. Additionally, or alternatively, the user interface may include one or more buttons (not shown) that enable user input. For example, the display 252 and/or user interface 254 may include buttons corresponding and in communication with trim tabs 262 that allow the user to manually adjust the positions of the trim tabs 262.

The user interface 254 may include, for example, a keyboard, keypad, function keys, mouse, scrolling device, input/output ports, touch screen, or any other mechanism by which a user may interface with the system.

In some example embodiments, the marine electronic device 246 may not have a display 252 or user interface 254 at all. Instead, the processor 248 and the memory 250 may be configured to automatically communicate and respond to elements such as the gyro stabilizer 256, interceptors 258, ballast tanks 260, trim tabs 262, sensors 266, and other stabilization mechanisms 264.

In some embodiments, the system 244 may comprise an autopilot navigation 268 that is configured to operate a motor 261 and/or a trolling motor 263 to propel the watercraft in a direction and at a speed. In some embodiments, the autopilot navigation 268 may direct the watercraft to a waypoint (e.g., a latitude and longitude coordinate). Additionally, or alternatively, the autopilot may be configured to direct the watercraft along a route, such as in conjunction with the navigation system. The processor 248 may generate display data based on the autopilot operating mode and cause an indication of the autopilot operating mode to be displayed on the digital display in the first portion, such as an autopilot icon. Further, the autopilot navigation 268 may communicate to the processor 248 that a turn is being made or that a turn is about to be made. The processor 248 may then cause one or more of the gyro stabilizer 256, interceptors 258, ballast tanks 260, trim tabs 262, and/or other stabilization mechanisms 264 to be neutralized or adjusted for a duration of the turn.

In an example embodiment, the sensors 266 of the system 244 may include a steering wheel sensor, such as an orientation sensor, movement sensor, or the like. The steering wheel sensor may be configured to detect when a steering wheel of the watercraft has been turned or moved past a predetermined threshold amount. The processor 248 may receive data from the steering wheel sensor and determine that a turn is being made. The processor 248 may then cause one or more of the gyro stabilizer 256, interceptors 258, ballast tanks 260, trim tabs 262, and/or other stabilization mechanisms 264 to be neutralized or adjusted for a duration of the turn.

In some embodiments, the system 244 further includes a power source (e.g., battery) that is configured to provide power to the various components. In some embodiments, the power source is rechargeable. In some example embodiments, sensors 266 of the system 244 includes a battery sensor. The battery sensor may include a current sensor or voltage sensor configured to measure the current charge of a battery power supply of the system 244 (e.g., the power source). The battery sensor may be configured to measure individual battery cells or measure a battery bank. The processor 248 may receive battery data from the battery sensor and determine the remaining charge on the battery. In an example embodiment, the voltage or current measured by the battery sensor may be compared to a reference value or data table, stored in memory 250, to determine the remaining charge on the battery.

In some embodiments, the system 244 may include other sensors among sensors 266. For example, in some embodiments, the system 244 may include a position sensor for measuring a detected angle of the watercraft with respect to a surface of a body of water, which may be logged by the processor. The detected angle may be utilized, e.g., for determining an adjustment value for one or more of the gyro stabilizer 256, interceptors 258, ballast tanks 260, trim tabs 262, and/or other stabilization mechanisms 264.

Implementations of various technologies described herein may be operational with numerous general purpose or special purpose computing system environments or configurations. Examples of well-known computing systems, environments, and/or configurations that may be suitable for use with the various technologies described herein include, but are not limited to, personal computers, server computers, hand-held or laptop devices, multiprocessor systems, microprocessor-based systems, set top boxes, programmable consumer electronics, network PCs, minicomputers, mainframe computers, smart phones, tablets, wearable computers, cloud computing systems, virtual computers, marine electronics devices, and the like.

The various technologies described herein may be implemented in general context of computer-executable instructions, such as program modules, being executed by a computer. Generally, program modules may include routines, programs, objects, components, data structures, etc. that performs particular tasks or implement particular abstract data types. Further, each program module may be implemented in its own way, and all need not be implemented the same way. While program modules may all execute on a single computing system, it should be appreciated that, in some instances, program modules may be implemented on separate computing systems and/or devices adapted to communicate with one another. Further, a program module may be some combination of hardware and software where particular tasks performed by the program module may be done either through hardware, software, or both.

The various technologies described herein may be implemented in the context of marine electronics, such as devices found in watercrafts and/or navigation systems. Ship instruments and equipment may be connected to the computing systems described herein for executing one or more navigation technologies. As such, the computing systems may be configured to operate using sonar, radar, GPS and like technologies.

The various technologies described herein may also be implemented in distributed computing environments where tasks are performed by remote processing devices that are linked through a communications network (e.g., by hardwired links, wireless links, or combinations thereof). In a distributed computing environment, program modules may be located in both local and remote computer storage media including memory storage devices.

The system 244 may include a computing device or system (e.g., mobile media device) into which implementations of various technologies and techniques described herein may be implemented. Computing device 274 may be a conventional desktop, a handheld device, a wearable device, a controller, a personal digital assistant, a server computer, an electronic device/instrument, a laptop, a tablet, or part of a navigation system, marine electronics, or sonar system. It should be noted, however, that other computer system configurations may be used.

In various implementations, each marine electronic device 246 described herein may be referred to as a marine device or as an MFD. The marine electronic device 246 may include one or more components disposed at various locations on a watercraft. Such components may include one or more data modules, sensors, instrumentation, and/or any other devices known to those skilled in the art that may transmit various types of data to the marine electronic device 246 for processing and/or display. The various types of data transmitted to the marine electronic device 246 may include marine electronics data and/or other data types known to those skilled in the art. The marine data received via the marine electronic device 246 or other components of the system 244 may include chart data, sonar data, structure data, radar data, navigation data, position data, heading data, automatic identification system (AIS) data, Doppler data, speed data, course data, or any other type known to those skilled in the art.

The marine electronic device 246 may receive external data via a LAN or a WAN. In some implementations, external data may relate to information not available from various marine electronics systems. The external data may be retrieved from various sources, such as, e.g., the Internet or any other source. The external data may include atmospheric temperature, atmospheric pressure, tidal data, weather, temperature, moon phase, sunrise, sunset, water levels, historic fishing data, and/or various other fishing and/or trolling related data and information.

The marine electronic device 246 may be attached to various buses and/or networks, such as a National Marine Electronics Association (NMEA) bus or network, for example. The marine electronic device 246 may send or receive data to or from another device attached to the NMEA 2000 bus. For instance, the marine electronic device 246 may transmit commands and receive data from a motor or a sensor using an NMEA 2000 bus. In some implementations, the marine electronic device 246 may be capable of steering a watercraft and controlling the speed of the watercraft (e.g., autopilot). For instance, one or more waypoints may be input to the marine electronic device 246, and the marine electronic device 246 may be configured to steer the watercraft to the one or more waypoints. Further, the marine electronic device 246 may be configured to transmit and/or receive NMEA 2000 compliant messages, messages in a proprietary format that do not interfere with NMEA 2000 compliant messages or devices, and/or messages in any other format. In various other implementations, the marine electronic device 246 may be attached to various other communication buses and/or networks configured to use various other types of protocols that may be accessed via, e.g., NMEA 2000, NMEA 0183, Ethernet, Proprietary wired protocol, etc. In some implementations, the marine electronic device 246 may communicate with various other devices on the watercraft via wireless communication channels and/or protocols.

In some implementations, the marine electronic device 246 may be connected to a global positioning system (GPS) receiver and/or any other sensors 266 such as motion sensors, magnetometers, attitude sensors, etc. The marine electronic device 246 and/or the GPS receiver and other sensors 266 may be connected via a network interface. In this instance, the GPS receiver and other sensors 266 may be used to determine position and coordinate data for a watercraft on which the marine electronic device 246 is disposed. In some instances, the GPS receiver and other sensors 266 may transmit position coordinate data to the marine electronic device 246. In various other instances, any type of known positioning system may be used to determine and/or provide position coordinate data to/for the marine electronic device 246.

In some embodiments, the marine electronic device 246 may be configured as a computing system similar to computing device 274.

Example Flowchart

Embodiments of the present disclosure provide methods for stabilizing a watercraft. Various examples of the operations performed in accordance with embodiments of the present disclosure will now be provided with reference to FIG. 13.

Figure 13:
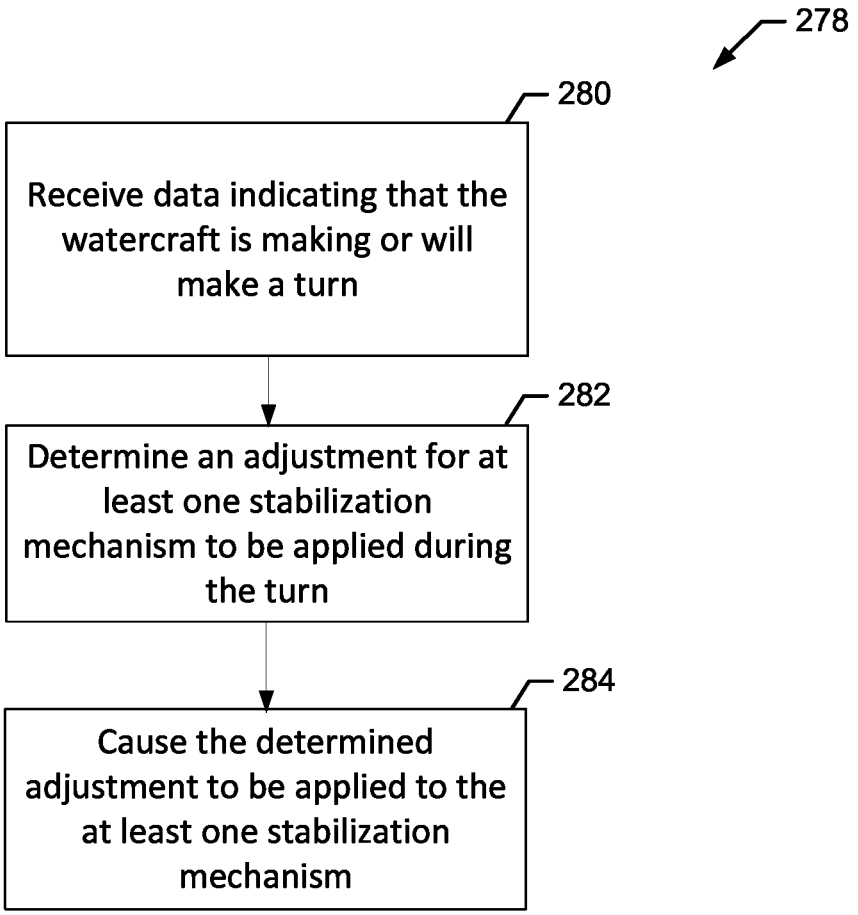
FIG. 13 shows an example method for stabilizing a watercraft, in accordance with some embodiments discussed herein.

FIG. 13 illustrates a flowchart according to an example method 278 for stabilizing a watercraft for a duration of a turn of the watercraft according to various example embodiments described herein. The operations illustrated in and described with respect to FIG. 13 may, for example, be performed by, with the assistance of, and/or under the control of one or more of the processor 248, memory 250, communication interface 270, user interface 254, display 252, gyro stabilizer 256, ballast tanks 260, interceptors, 258, trim tabs 262, other stabilization mechanisms 264, sensors 266, computing device 274, remote device 276, and/or other components described herein.

Operation 280 may comprise receiving data from at least one of a navigation assembly, a memory, or a sensor indicating that the watercraft is making or will make a turn. For example, in some embodiments, operation 280 may include receiving data from a sensor that is on or connected to a steering wheel of the watercraft that indicates that the steering wheel has moved or turned past a predetermined threshold. In some other embodiments, operation 280 may additionally or alternatively include receiving data from an autopilot navigation assembly indicating that the watercraft has begun to make a turn or that the watercraft is about to initiate a turn. Further, in some embodiments, operation 280 may also include receiving information such as a detected or predicted tilt angle of the watercraft during the turn. Additionally or alternatively, operation 280 may include receiving data such as vessel attitude data (e.g., indicating the heading of the watercraft) that indicates that the watercraft is engaging in or is about to engage in a turn. The processor 248, marine electronic device 246, display 252, and/or computing device 274 may, for example, provide means for performing operation 280.

Operation 282 may comprise determining an adjustment for at least one stabilization mechanism to be applied during the turn. In some embodiments, operation 282 may include determining more than one adjustment to be applied to each of the stabilization mechanisms, and the operation 282 may further comprise optimizing the adjustments to obtain an efficient combination of adjustments. The processor 248, marine electronic device 246, display 252, and/or computing device 274 may, for example, provide means for performing operation 282.

Operation 284 may comprise causing the determined adjustment to be applied to the at least one stabilization mechanism. For example, operation 284 may involve causing a starboard trim tab on a watercraft to be neutralized and a port trim tab to be lowered to 5 degrees. In some embodiments, operation 284 may also include re-adjusting the at least one stabilization mechanism after the turn is complete such that the at least one stabilization mechanism returns to its previous parameters. For example, after the turn is complete, operation 284 may include re-adjusting the starboard trim tab by lowering it back to its previous position of 10 degrees and raising the port trim tab back to its previous neutral position. In some other embodiments, operation 284 may not include re-adjusting the at least one stabilization mechanism after the turn is complete. The processor 248, marine electronic device 246, display 252, and/or computing device 274 may, for example, provide means for performing operation 284.

FIG. 13 illustrates a flowchart of a system, method, and/or computer program product according to an example embodiment. It will be understood that each block of the flowchart, and combinations of blocks in the flowchart, may be implemented by various means, such as hardware and/or a computer program product comprising one or more computer-readable mediums having computer readable program instructions stored thereon. For example, one or more of the procedures described herein may be embodied by computer program instructions of a computer program product. In this regard, the computer program product(s) which embody the procedures described herein may be stored by, for example, the memory 250 and executed by, for example, the processor 248 or controller. As will be appreciated, any such computer program product may be loaded onto a computer or other programmable apparatus to produce a machine, such that the computer program product including the instructions which execute on the computer or other programmable apparatus creates means for implementing the functions specified in the flowchart block(s). Further, the computer program product may comprise one or more non-transitory computer-readable mediums on which the computer program instructions may be stored such that the one or more computer-readable memories can direct a computer or other programmable device to cause a series of operations to be performed on the computer or other programmable apparatus to produce a computer-implemented process such that the instructions which execute on the computer or other programmable apparatus implement the functions specified in the flowchart block(s).

In some embodiments, the method for operating various marine devices may include additional, optional operations, and/or the operations described above may be modified or augmented.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A system for stabilizing a watercraft, the system comprising:

a navigation assembly;

at least one stabilization mechanism for stabilizing the watercraft, the at least one stabilization mechanism configured to apply a stabilization force onto the watercraft in an effort to cause the watercraft to maintain a relative orientation with a body of water;

a processor; and a memory including computer executable instructions, the computer executable instructions configured to, when executed by the processor, cause the processor to:

receive data from at least one of the navigation assembly, the memory, or a sensor, wherein the data indicates that the watercraft is making a turn or will make the turn;

determine, based on the data, an adjustment for the at least one stabilization mechanism to be applied during the turn by the watercraft, wherein the adjustment reduces the stabilization force being applied by the at least one stabilization mechanism to aid in making the turn, wherein the determined adjustment for the at least one stabilization mechanism is designed to cause a floor of the watercraft to maintain a relative orientation with the body of water that is at least less than 35 degrees; and cause the determined adjustment to be applied to the at least one stabilization mechanism before or as the turn begins.

2. The system of claim 1, wherein the navigation assembly is an autopilot navigation assembly.

3. The system of claim 2, wherein the processor is configured to receive the data from the autopilot navigation assembly indicating that the watercraft will make the turn, wherein the adjustment causes the adjusted stabilization force to be applied by the at least one stabilization mechanism to aid in making the turn.

4. The system of claim 1, wherein the navigation assembly is following a predetermined navigation route, wherein the processor is configured to receive the data from the navigation assembly indicating that the watercraft will make the turn.

5. The system of claim 1, wherein the navigation assembly comprises a steering wheel, and wherein the data indicates that the watercraft is making a turn when the steering wheel has been turned a predetermined number of degrees, and wherein the adjustment is applied when the turn begins.

6. The system of claim 1, wherein the at least one stabilization mechanism is at least two stabilization mechanisms, wherein the processor is configured to determine, based on the data, an adjustment for each of the at least two stabilization mechanisms to be applied during the turn by the watercraft, and wherein the processor is further configured to determine the adjustments for each of the at least two stabilization mechanisms proportionately.

7. The system of claim 1, wherein the processor predicts a numerical value of instability to be caused by the turn.

8. The system of claim 7, wherein the numerical value of instability is used to determine the adjustment.

9. The system of claim 1, wherein the processor is further configured to cause the determined adjustment to be applied to the at least one stabilization mechanism when the turn begins, and wherein the processor adjusts the at least one stabilization mechanism within select parameters based on detected circumstances of the turn.

10. The system of claim 9, wherein the detected circumstances are at least one of weather conditions or waves.

11. The system of claim 1, wherein the at least one stabilization mechanism comprises at least one of a gyro stabilizer, a trim tab system, a steering stabilization mechanism, interceptors, fin stabilizers, or one or more ballast tanks.

12. The system of claim 1, wherein the at least one stabilization mechanism is a trim tab system, wherein the processor is further configured to communicate a tilt value from the navigation assembly to the trim tab system according to a detected or predicted instability value associated with the turn, and wherein the tilt value is used to determine the adjustment.

13. The system of claim 12, wherein the tilt value communicated to the trim tab system is calculated such that the watercraft remains stable during the turn.

14. The system of claim 12, wherein the processor is further configured to cause the trim tab system to return to an initial condition after the turn has been completed.

15. The system of claim 1, wherein causing the determined adjustment to be applied to the at least one stabilization mechanism according to the received data comprises temporarily disengaging the at least one stabilization mechanism for a duration of the turn.

16. The system of claim 15, wherein the processor is further configured to reengage the at least one stabilization mechanism after the duration of the turn.

17. A method for stabilizing a watercraft, the method comprising:

receiving data from at least one of a navigation assembly, a memory, or a sensor, wherein the data indicates that the watercraft is making a turn or will make the turn;

determining, based on the data, an adjustment for at least one stabilization mechanism to be applied during the turn by the watercraft, wherein the at least one stabilization mechanism is configured to stabilize the watercraft by applying a stabilization force onto the watercraft in an effort to cause the watercraft to maintain a relative orientation with a body of water, wherein the adjustment reduces the stabilization force being applied by the at least one stabilization mechanism to aid in making the turn, wherein the determined adjustment for the at least one stabilization mechanism is designed to cause a floor of the watercraft to maintain a relative orientation with the body of water that is at least less than 35 degrees; and causing the determined adjustment to be applied to the at least one stabilization mechanism before or as the turn begins.

18. A marine electronic device, the marine electronic device comprising:

a processor; and a memory including computer executable instructions, the computer executable instructions configured to, when executed by the processor, cause the processor to:

receive data from at least one of a navigation assembly, the memory, or a sensor, wherein the data indicates that a watercraft is making a turn or will make the turn;

determine, based on the data, an adjustment for at least one stabilization mechanism to be applied during the turn by the watercraft, wherein the at least one stabilization mechanism is configured to stabilize the watercraft by applying a stabilization force onto the watercraft in an effort to cause the watercraft to maintain a relative orientation with a body of water, wherein the adjustment reduces the stabilization force being applied by the at least one stabilization mechanism to aid in making the turn, wherein the determined adjustment for the at least one stabilization mechanism is designed to cause a floor of the watercraft to maintain a relative orientation with the body of water that is at least less than 35 degrees; and cause the determined adjustment to be applied to the at least one stabilization mechanism before or as the turn begins.

* * * * *